US009606498B2

(12) United States Patent
Nishizawa et al.

(10) Patent No.: US 9,606,498 B2
(45) Date of Patent: Mar. 28, 2017

(54) ELECTRONIC-COMPONENT ATTACHMENT STRUCTURE, ATTACHABLE-DETACHABLE UNIT, AND IMAGE FORMING APPARATUS

(71) Applicant: FUJI XEROX CO., LTD., Tokyo (JP)

(72) Inventors: Katsuyuki Nishizawa, Kanagawa (JP); Ryuji Hattori, Kanagawa (JP); Shota Makita, Kanagawa (JP); Kazuya Nishimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/877,168

(22) Filed: Oct. 7, 2015

(65) Prior Publication Data

US 2016/0248185 A1 Aug. 25, 2016

(30) Foreign Application Priority Data

Feb. 19, 2015 (JP) ..... 2015-030251

(51) Int. Cl.

| | |
|---|---|
| ***G03G 21/18*** | (2006.01) |
| ***G03G 15/00*** | (2006.01) |
| ***G03G 21/16*** | (2006.01) |
| *H01R 12/71* | (2011.01) |

(52) U.S. Cl.

CPC ..... *G03G 15/80* (2013.01); *G03G 21/1652* (2013.01); *G03G 21/1867* (2013.01); *H01R 12/714* (2013.01)

(58) Field of Classification Search

CPC ..... G03G 21/1885

See application file for complete search history.

(56) References Cited

U.S. PATENT DOCUMENTS

| | | | | |
|---|---|---|---|---|
| 6,641,049 | B2 * | 11/2003 | Luu | G06K 19/0719 235/441 |
| 6,892,039 | B2 * | 5/2005 | Okamoto | B41J 2/17526 399/119 |
| 6,898,392 | B2 * | 5/2005 | Karakama | G03G 21/1853 399/111 |
| 7,264,501 | B1 * | 9/2007 | Lin | H05K 7/142 174/138 G |
| 7,689,144 | B2 * | 3/2010 | Martin | B41J 2/17546 399/109 |
| 7,813,144 | B2 * | 10/2010 | Maeda | H05K 7/142 361/742 |

(Continued)

FOREIGN PATENT DOCUMENTS

| | | | |
|---|---|---|---|
| JP | 2011107645 A | | 6/2011 |
| JP | 2012098487 A | * | 5/2012 |

*Primary Examiner* — Minh Phan
*Assistant Examiner* — Leon W Rhodes, Jr.
(74) *Attorney, Agent, or Firm* — Oliff PLC

(57) ABSTRACT

An electronic-component attachment structure includes an electronic component and a support member. The electronic component has a connection electrode exposed on a surface of a substrate. The support member supports the substrate of the electronic component in abutment with an attachment surface so as to allow the connection electrode to be externally connectable. The support member has a positioning supporter that elastically deforms by being relatively joined to a positioning portion provided in the substrate and that positions and supports the substrate to the attachment surface with restoring force generated as a result of the elastic deformation.

11 Claims, 20 Drawing Sheets

(56) References Cited

U.S. PATENT DOCUMENTS

| | | | | |
|---|---|---|---|---|
| 7,840,160 | B2 * | 11/2010 | Shimomura | G03G 21/1652 399/119 |
| 8,435,048 | B2 * | 5/2013 | Fahllund | H01R 13/6315 439/328 |
| 8,947,884 | B1 * | 2/2015 | Grimm | H05K 7/142 361/679.31 |
| 9,134,674 | B2 * | 9/2015 | Oda | G03G 15/0863 |
| 2002/0002012 | A1 * | 1/2002 | Torii | H01R 12/725 439/625 |
| 2013/0236197 | A1 * | 9/2013 | Yoshida | G03G 15/0886 399/12 |
| 2014/0086597 | A1 * | 3/2014 | Tanabe | G03G 21/1867 399/12 |
| 2015/0037050 | A1 * | 2/2015 | Kimura | G03G 21/1885 399/12 |

* cited by examiner

ELECTRONIC-COMPONENT ATTACHMENT STRUCTURE, ATTACHABLE-DETACHABLE UNIT, AND IMAGE FORMING APPARATUS

CROSS-REFERENCE TO RELATED APPLICATIONS

This application is based on and claims priority under 35 USC 119 from Japanese Patent Application No. 2015-030251 filed Feb. 19, 2015.

BACKGROUND

Technical Field

The present invention relates to electronic-component attachment structures, attachable-detachable units, and image forming apparatuses.

SUMMARY

According to an aspect of the invention, there is provided an electronic-component attachment structure including an electronic component and a support member. The electronic component has a connection electrode exposed on a surface of a substrate. The support member supports the substrate of the electronic component in abutment with an attachment surface so as to allow the connection electrode to be externally connectable. The support member has a positioning supporter that elastically deforms by being relatively joined to a positioning portion provided in the substrate and that positions and supports the substrate to the attachment surface with restoring force generated as a result of the elastic deformation.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

First Exemplary Embodiment

Figure 1:
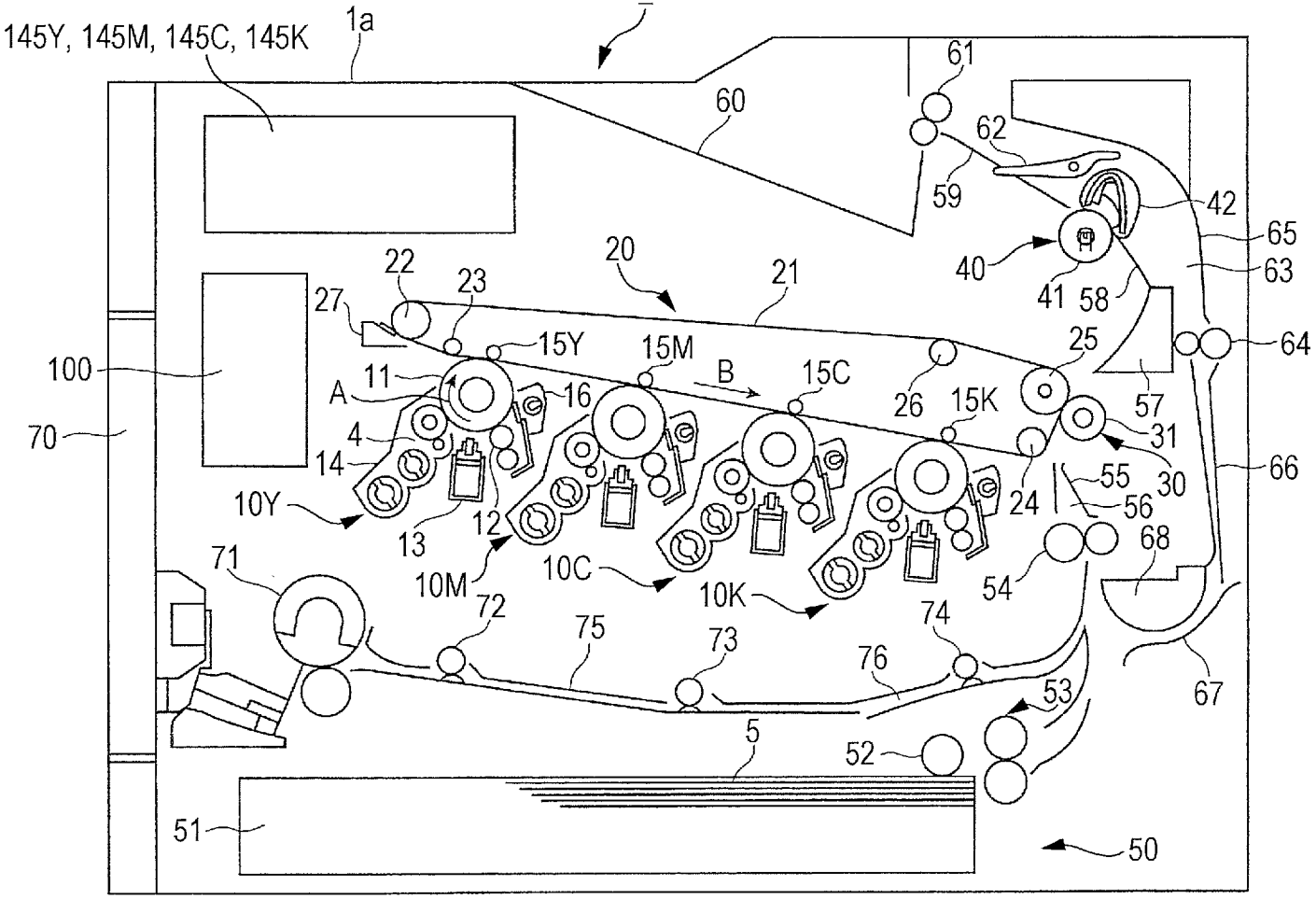
FIG. 1 schematically illustrates the overall configuration of an image forming apparatus to which an electronic-component attachment structure and an attachable-detachable unit according to a first exemplary embodiment of the present invention are applied.
Figure 2:
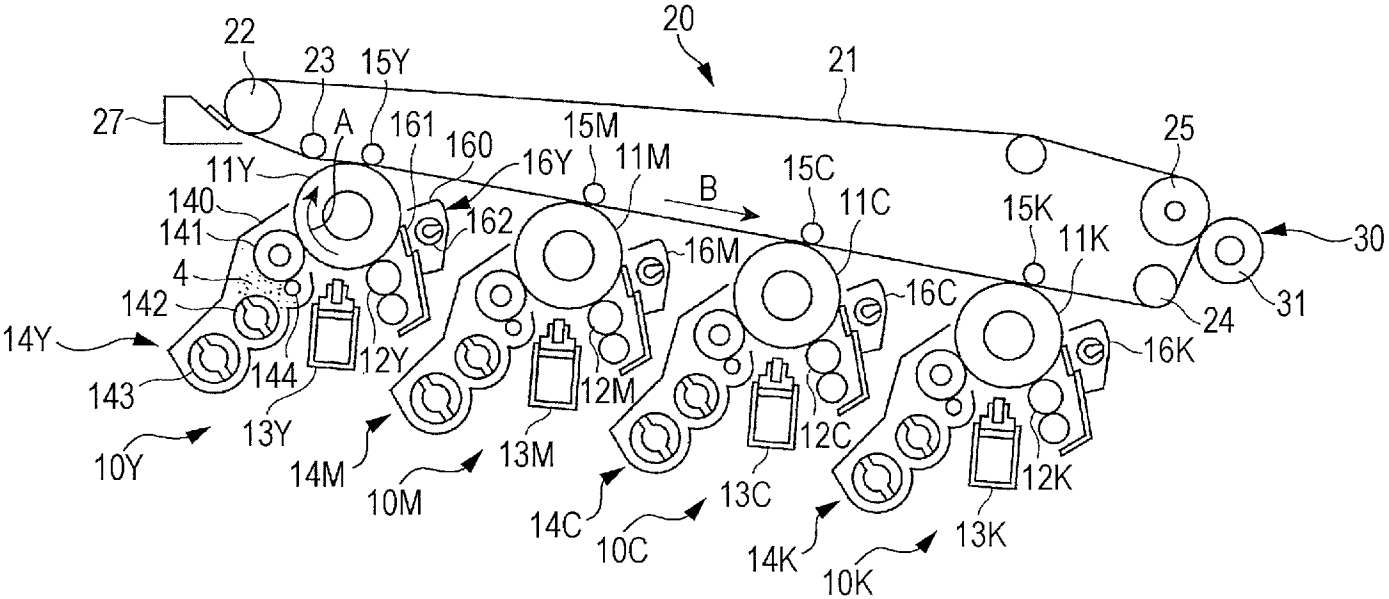
FIG. 2 illustrates the configuration of an image forming section of the image forming apparatus according to the first exemplary embodiment of the present invention.

FIG. 1 schematically illustrates the overall configuration of an image forming apparatus to which an electronic-component attachment structure and an attachable-detachable unit according to a first exemplary embodiment of the present invention are applied. FIG. 2 is an enlarged view illustrating a relevant part (such as an image forming device) of the image forming apparatus.

Overall Configuration of Image Forming Apparatus

An image forming apparatus 1 according to the first exemplary embodiment is, for example, a color printer. The image forming apparatus 1 includes, for example, multiple image forming devices 10 that form toner images developed by using toners that constitute developers 4, an intermediate transfer device 20 that carries the toner images formed by the image forming devices 10 and transports the toner images to a second-transfer position where the toner images are ultimately second-transferred onto a recording sheet 5 as an example of a recording medium, a sheet feed device 50 that accommodates and transports a predetermined recording sheet 5 to be fed to the second-transfer position of the intermediate transfer device 20, and a fixing device 40 that fixes the toner images second-transferred on the recording sheet 5 at the intermediate transfer device 20. In FIG. 1, reference sign "1*a*" denotes a body of the image forming apparatus 1. This body 1*a* is constituted of, for example, a support structure member and an outer cover.

The image forming devices 10 include four image forming devices 10Y, 10M, 10C, and 10K that dedicatedly form toner images of four colors, namely, yellow (Y), magenta (M), cyan (C), and black (K), respectively. These four image forming devices 10 (Y, M, C, and K) are arranged in a single slanted row within the internal space of the body 1*a*.

As shown in FIGS. 1 and 2, each of the image forming devices 10 (Y, M, C, and K) includes a rotatable photoconductor drum 11 as an example of an image bearing member. The photoconductor drum 11 is surrounded by the following devices as an example of toner-image forming units. The devices include a charging device 12 that electrostatically charges an image-formable peripheral surface (image bearing surface) of the photoconductor drum 11 to a predetermined potential, an exposure device 13 that radiates light based on image information (signal) onto the electrostatically-charged peripheral surface of the photoconductor drum 11 so as to form an electrostatic latent image (for the corresponding color) having a potential difference, a developing device 14 (Y, M, C, or K) that develops the electrostatic latent image into a toner image by using a toner of a developer 4 for the corresponding color (Y, M, C, or K), a first-transfer device 15 (Y, M, C, or K) as an example of a first-transfer unit that transfers the toner image onto the intermediate transfer device 20, and a drum cleaning device 16 (Y, M, C, or K) that cleans the image bearing surface of the photoconductor drum 11 by removing extraneous matter, such as toner, remaining on and adhered to the image bearing surface after the first-transfer process.

The photoconductor drum 11 is obtained by forming an image bearing surface having a photoconductive layer (photosensitive layer) composed of a photoconductive material around the peripheral surface of a ground-connected cylindrical or columnar base. The photoconductor drum 11 is supported in a manner such that it rotates in a direction indicated by an arrow A by receiving power from a rotational driving device (not shown).

The charging device 12 is constituted of a contact-type charging roller disposed in contact with the photoconductor drum 11. The charging device 12 is supplied with charge voltage. With regard to the charge voltage, if the developing device 14 is configured to perform reverse development, voltage or current with the same polarity as the charge voltage of the toner supplied from the developing device 14 is supplied thereto. The charging device 12 may alternatively be of a noncontact type, such as scorotron, disposed out of contact with the surface of the photoconductor drum 11.

The exposure device 13 forms an electrostatic latent image by radiating light according to image information input to the image forming apparatus 1 onto the electrostatically-charged peripheral surface of the photoconductor drum 11. When forming a latent image, image information (signal) input to the image forming apparatus 1 via an arbitrary unit is transmitted to the exposure device 13.

The exposure device 13 is constituted of a light-emitting-diode (LED) print head that radiates light according to the image information onto the photoconductor drum 11 by using LEDs as multiple light emitting elements arranged in the axial direction of the photoconductor drum 11, so as to form an electrostatic latent image on the photoconductor drum 11. The exposure device 13 may alternatively be configured to polarize and scan laser light according to the image information in the axial direction of the photoconductor drum 11.

As shown in FIG. 2, the developing devices 14 (Y, M, C, and K) each have a housing 140 having an opening and a chamber for accommodating the corresponding developer 4. The housing 140 accommodates therein a developing roller 141 that carries and transports the developer 4 to a development region where it faces the photoconductor drum 11, two stirring transport members 142 and 143 such as screw augers that transport the developer 4 so as to cause the developer 4 to pass the developing roller 141 while stirring the developer 4, and a layer-thickness regulation member 144 that regulates the amount (layer thickness) of developer carried by the developing roller 141. A power supply device (not shown) supplies development voltage between the developing roller 141 of the developing device 14 and the photoconductor drum 11. The developing roller 141 and the stirring transport members 142 and 143 each rotate in a predetermined direction by receiving power from a rotational driving device (not shown). Furthermore, as each of the developers 4 of the four colors (Y, M, C, and K), a two-component developer containing a nonmagnetic toner and a magnetic carrier is used.

Each of the first-transfer devices 15 (Y, M, C, and K) is a contact-type transfer device having a first-transfer roller that rotates by being in contact with the periphery of the corresponding photoconductor drum 11 via an intermediate transfer belt 21 and that is supplied with first-transfer voltage. With regard to the first-transfer voltage, direct-current voltage with the opposite polarity to the charge polarity of the toner is supplied from a power supply device (not shown).

As shown in FIG. 2, each drum cleaning device 16 is constituted of, for example, a container-shaped body 160 partly having an opening, a cleaning plate 161 that is disposed in contact with the peripheral surface of the corresponding photoconductor drum 11 with predetermined pressure and removes extraneous matter, such as residual toner, therefrom so as to clean the peripheral surface of the photoconductor drum 11 after the first-transfer process, and a delivery member 162 such as a screw auger that collects the extraneous matter, such as toner, removed by the cleaning plate 161 and transports the extraneous matter to a collecting system (not shown). As the cleaning plate 161, a plate-shaped member (e.g., a blade) composed of, for example, a rubber material is used.

In this exemplary embodiment, the image forming members, such as the photoconductor drum 11 as well as the charging device 12, the developing device 14, and the drum cleaning device 16 disposed around the photoconductor drum 11, are integrated into a single unit so as to constitute a process cartridge 80 as an example of an attachable-detachable unit.

Figure 3:
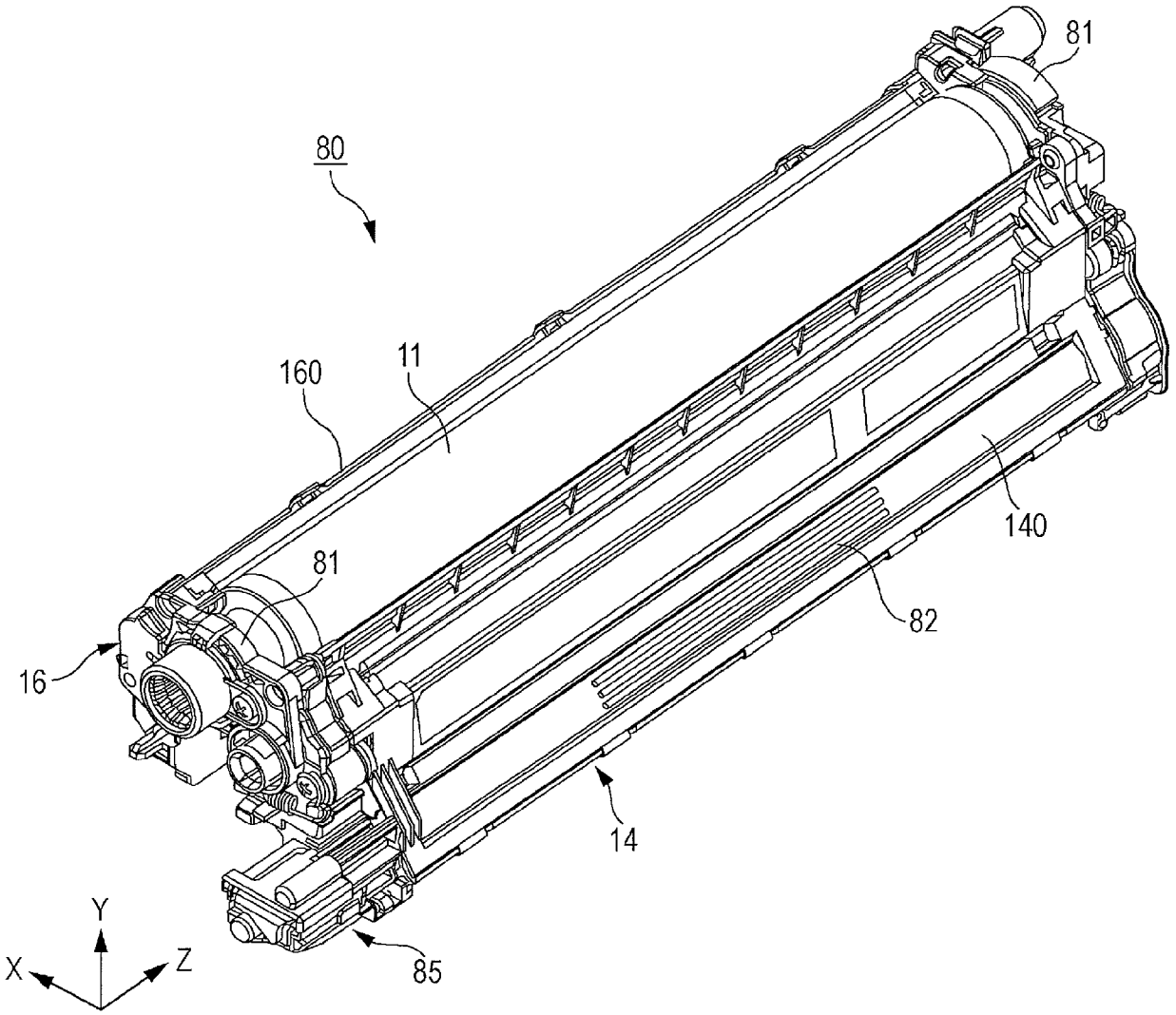
FIG. 3 is a perspective view illustrating a process cartridge.
Figure 4:
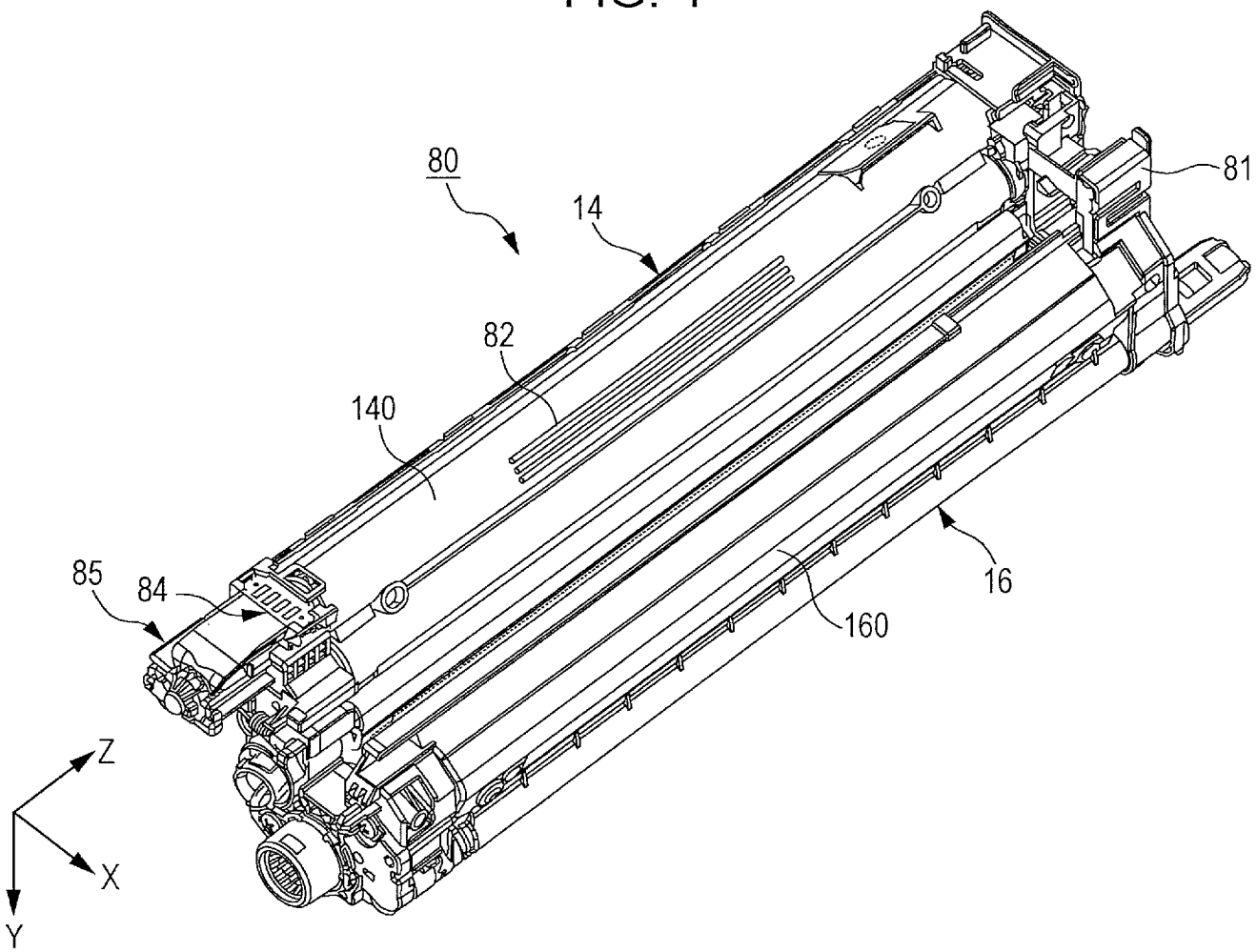
FIG. 4 is another perspective view illustrating the process cartridge.

FIG. 3 is an external perspective view illustrating one of the process cartridges 80, as viewed from above. FIG. 4 is another external perspective view illustrating the process cartridge 80, as viewed from below.

Figure 5:
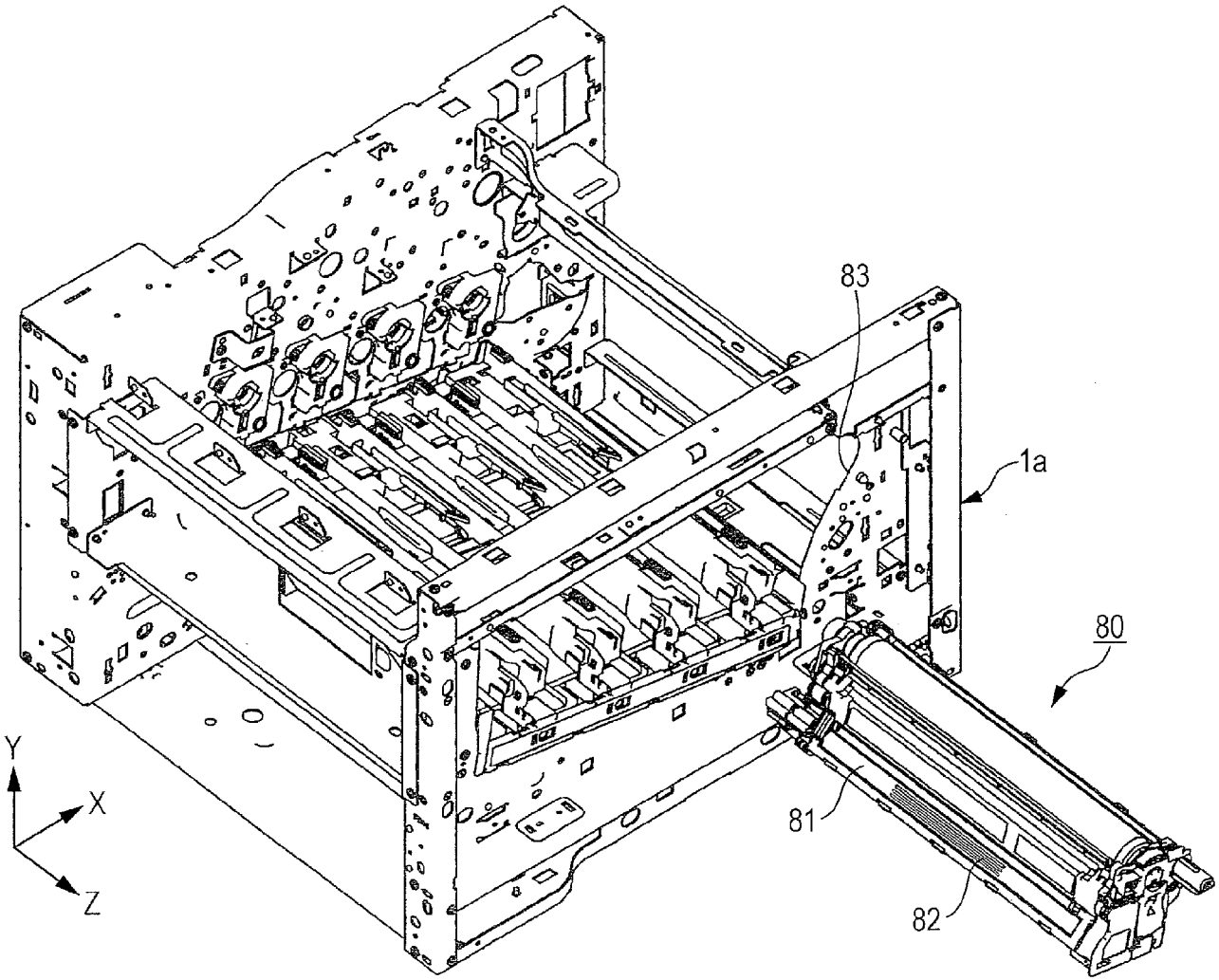
FIG. 5 is a perspective view illustrating a state where the process cartridge is being attached to an image-forming-apparatus body.

As shown in FIGS. 3 and 4, the process cartridge 80 includes a process cartridge body 81 as an example of an attachable-detachable-unit body to which the photoconductor drum 11, the charging device 12, the developing device 14, and the drum cleaning device 16 are integrally attached. In the exemplary embodiment shown in FIGS. 3 and 4, the process cartridge body 81 is constituted of, for example, the housing 140 of the developing device 14, the body 160 of the drum cleaning device 16, and frame members disposed at opposite axial ends of the photoconductor drum 11. As shown in FIG. 5, the process cartridge 80 is attachable to and detachable from the image-forming-apparatus body 1*a* via a guide member (not shown) provided at the body 1*a* of the image forming apparatus 1. As shown in FIGS. 3 and 4, the process cartridge body 81 is provided with a handle 82 that is to be manually gripped by a user when attaching or detaching the process cartridge 80 to or from the image-forming-apparatus body 1*a*. The handle 82 extends in the longitudinal direction at the outer peripheral surface and the inner peripheral surface of the housing 140 of the developing device 14. The process cartridge 80 does not necessarily have to include all of the image forming members, such as the photoconductor drum 11 as well as the charging device 12, the developing device 14, and the drum cleaning device 16 disposed around the photoconductor drum 11. Of these image forming members, the process cartridge 80 may be constituted of the photoconductor drum 11, the charging device 12, and the developing device 14, or may be constituted of, for example, the photoconductor drum 11 and the developing device 14.

As shown in FIG. 5, the image-forming-apparatus body 1*a* includes a side cover (not shown) at the right side surface relative to the front surface thereof (i.e., a side surface that the user faces during operation). The side cover is attached to the image-forming-apparatus body 1*a* in an openable-closable manner via a hinge (not shown).

Figure 6:
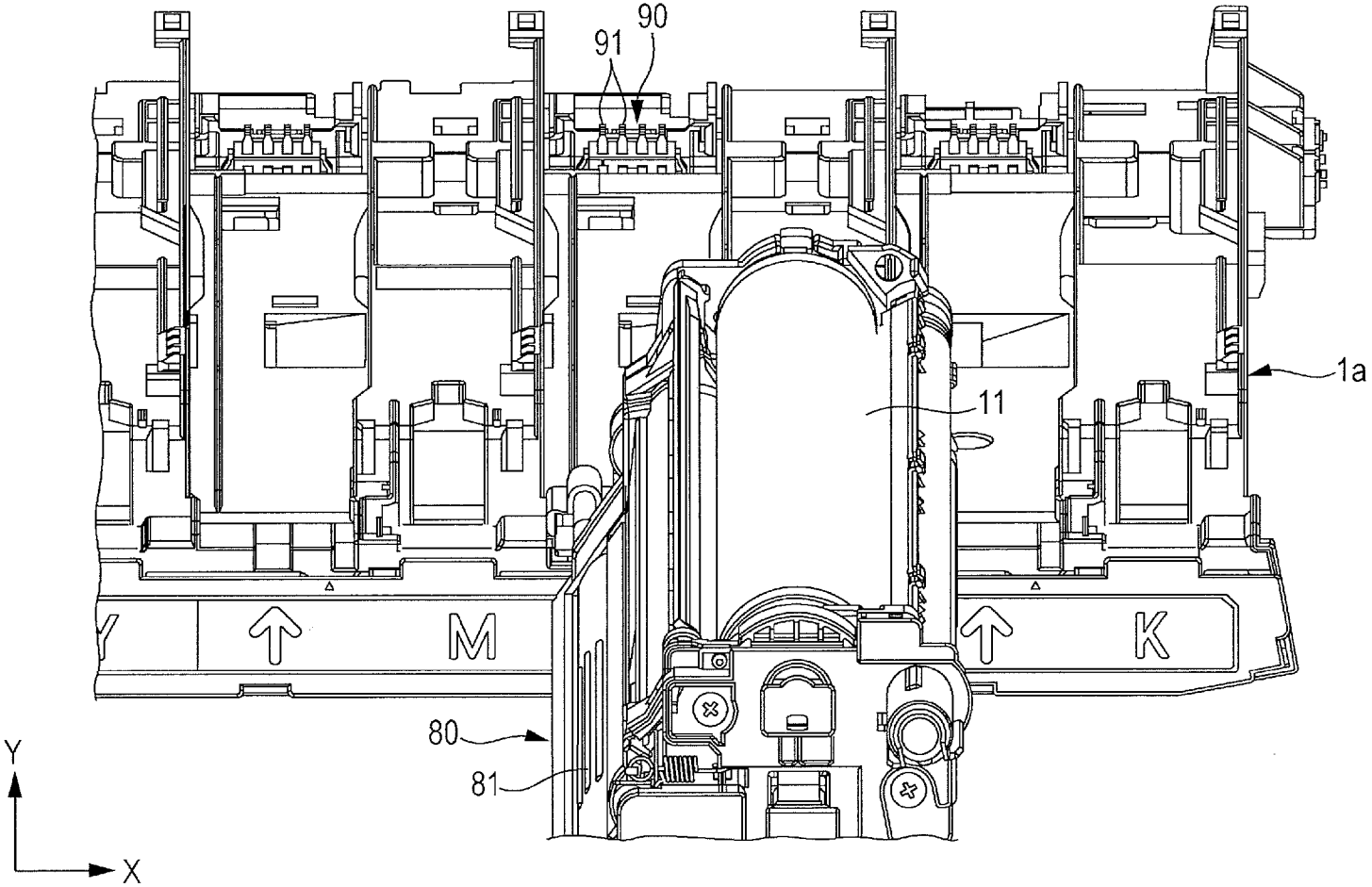
FIG. 6 is another perspective view illustrating a state where the process cartridge is being attached to the image-forming-apparatus body.

The image-forming-apparatus body 1*a* has an opening 83 at the right side surface thereof for attaching and detaching the process cartridge 80. The process cartridge 80 is moved through the opening 83 along a guide member, such as a guide rail (not shown), provided inside the image-forming-apparatus body 1*a* so as to be attached to or detached from the image-forming-apparatus body 1*a*, as shown in FIG. 6. When attached to the image-forming-apparatus body 1*a*, the process cartridge 80 receives driving force and electric power from the image-forming-apparatus body 1*a*. Furthermore, when attached to the image-forming-apparatus body 1*a*, the process cartridge 80 becomes electrically connected to a control device 100, which will be described later, via a connector member 90 as an example of a connection terminal provided at the image-forming-apparatus body 1*a*, thereby becoming capable of exchanging an electric signal (i.e., communicating) with the control device 100.

As shown in FIG. 1, the intermediate transfer device 20 is disposed at a position above the image forming devices 10 (Y, M, C, and K). The intermediate transfer device 20 is constituted of, for example, the intermediate transfer belt 21 that rotates in a direction indicated by an arrow B while passing through first-transfer positions between the photoconductor drums 11 and the first-transfer devices 15 (first-transfer rollers), multiple belt support rollers 22 to 26 that rotatably support the intermediate transfer belt 21 from the inner surface thereof and maintain the intermediate transfer belt 21 in a desired position, a second-transfer device 30 as an example of a second-transfer member that is disposed at the outer peripheral surface (i.e., image bearing surface) of the intermediate transfer belt 21 supported by the belt support roller 25 and that second-transfers the toner images on the intermediate transfer belt 21 onto the recording sheet 5, and a belt cleaning device 27 that cleans the outer peripheral surface of the intermediate transfer belt 21 by removing extraneous matter, such as toner and paper particles, remaining on and adhered to the outer peripheral surface that has passed through the second-transfer device 30.

The intermediate transfer belt 21 is, for example, an endless belt composed of a material obtained by distributing a resistance regulator, such as carbon black, in synthetic resin, such as polyimide resin or polyamide resin. The belt support roller 22 serves as a driving roller that is rotationally driven by a driving device (not shown). The belt support rollers 23 and 26 serve as driven rollers that maintain, for example, the traveling position of the intermediate transfer belt 21. The belt support roller 24 serves as a tension applying roller that applies tension to the intermediate transfer belt 21. The belt support roller 25 serves as a second-transfer backup roller.

As shown in FIG. 1, the second-transfer device 30 is a contact-type transfer device equipped with a second-transfer roller 31 that is supplied with second-transfer voltage and that rotates while being in contact with the peripheral surface of the intermediate transfer belt 21 at the second-transfer position, which is an area of the outer peripheral surface of the intermediate transfer belt 21 supported by the belt support roller 25 in the intermediate transfer device 20. The second-transfer roller 31 or the belt support roller 25 of the intermediate transfer device 20 is supplied with direct-current voltage as second-transfer voltage with the opposite polarity to or the same polarity as the charge polarity of the toners.

The belt cleaning device 27 is constituted of, for example, a cleaning plate disposed in contact with the peripheral surface of the intermediate transfer belt 21 with predetermined pressure and removes extraneous matter, such as residual toner, so as to clean the peripheral surface of the intermediate transfer belt 21 after the second-transfer process. As the cleaning plate, a plate-shaped member (e.g., a blade) composed of, for example, a rubber material is used.

The fixing device 40 includes, for example, a drum-type or belt-type heating rotatable member 41 that is heated by a heater such that the surface temperature thereof is maintained at a predetermined temperature, and a drum-type or belt-type pressing rotatable member 42 that extends substantially in the axial direction of the heating rotatable member 41 and rotates while being in contact with the heating rotatable member 41 with predetermined pressure. In the fixing device 40, a contact area where the heating rotatable member 41 and the pressing rotatable member 42 are in contact with each other serves as a fixing process section where a predetermined fixing process (i.e., heating and pressing) is performed.

The sheet feed device 50 is disposed at a position below the yellow (Y), magenta (M), cyan (C), and black (K) image forming devices 10 (Y, M, C, and K). The sheet feed device 50 is constituted of a single (or multiple) sheet container 51 that accommodates a stack of recording sheets 5 of a predetermined size and type, and delivery devices 52 and 53 that deliver the recording sheets 5 one-by-one from the sheet container 51. For example, the sheet container 51 is attached in an ejectable manner from the front surface of the body 1*a* (i.e., the side surface that the user faces during operation), which is the left side surface in FIG. 1.

Examples of a recording sheet 5 include plain paper used in electrophotographic copiers and printers and an overhead projector (OHP) sheet. In order to further enhance the smoothness of the image surface after the fixing process, it is desirable that the surface of a recording sheet 5 be as smooth as possible. For example, coated paper obtained by coating the surface of plain paper with, for example, resin or a so-called cardboard with a relatively large basis weight, such as printable art paper, may be used.

A sheet transport path 56 constituted of, for example, a single pair (or multiple pairs) of sheet transport rollers 54 and a transport guide 55 that transport a recording sheet 5 delivered from the sheet feed device 50 to the second-transfer position is provided between the sheet feed device 50 and the second-transfer device 30. The pair of sheet transport rollers 54 serves as, for example, rollers (i.e., registration rollers) that adjust the transport timing of the recording sheet 5. Furthermore, for example, transport guides 57 and 58 for transporting the recording sheet 5, which has undergone the second-transfer process and is delivered from the second-transfer roller 31 of the second-transfer device 30, to the fixing device 40 are provided between the second-transfer device 30 and the fixing device 40. Moreover, a pair of sheet output rollers 61 for outputting the recording sheet 5, which has undergone the fixing process and is delivered from the fixing device 40, along a transport guide 59 to a sheet output section 60 provided at an upper portion of the body 1*a* is disposed in an area near a sheet output port formed in the body 1*a*.

A switch gate 62 that switches between sheet transport paths is provided between the fixing device 40 and the pair of sheet output rollers 61. The rotational direction of the pair of sheet output rollers 61 is switchable between the forward direction (i.e., outputting direction) and the reverse direction. If images are to be formed on both faces of the recording sheet 5, the rotational direction of the pair of sheet output rollers 61 is switched from the forward direction (i.e., outputting direction) to the reverse direction after the trailing edge of the recording sheet 5 having an image formed on one face thereof passes through the switch gate 62. The transport path of the recording sheet 5 transported in the reverse direction by the pair of sheet output rollers 61 is switched by the switch gate 62 so that the recording sheet 5 is transported to a duplex transport path 63 extending substantially in the vertical direction. The duplex transport path 63 includes, for example, a pair of sheet transport rollers 64 that transport the inverted recording sheet 5 to the pair of sheet transport rollers 54, and transport guides 65 to 68.

In FIG. 1, reference sign "70" denotes a manual feed tray provided in an openable-closable manner at the front surface (i.e., the left side surface in FIG. 1) of the body 1*a* of the image forming apparatus 1. A delivery device 71 that delivers recording sheets 5 accommodated in the manual feed tray 70 one-by-one and a manual-feed sheet transport path 76 constituted of, for example, multiple pairs of sheet transport rollers 72 to 74 and a transport guide 75 are provided between the manual feed tray 70 and the pair of sheet transport rollers 54.

In FIG. 1, reference sign "145 (Y, M, C, K)" denotes multiple toner cartridges as developer containers that are arranged in a direction orthogonal to the plane of the drawing and that individually accommodate developers at least containing toners to be supplied to the corresponding developing devices 14 (Y, M, C, and K).

In FIG. 1, reference sign "100" denotes a control device that controls the overall operation of the image forming apparatus 1. The control device 100 includes a central processing unit (CPU), a read-only memory (ROM), and a random access memory (RAM), or includes a bus or communication interface that connects the CPU, the ROM, and the like. These components are not shown in FIG. 1.

Operation of Image Forming Apparatus

A basic image forming operation performed by the image forming apparatus 1 will be described below.

The following description relates to an operation in which the four image forming devices 10 (Y, M, C, and K) are used for forming a full-color image by combining toner images of four colors (Y, M, C, and K).

When command information for requesting an image forming operation (printing) is received, the image forming apparatus 1 activates, for example, the four image forming devices 10 (Y, M, C, and K), the intermediate transfer device 20, the second-transfer device 30, and the fixing device 40.

In each of the image forming devices 10 (Y, M, C, and K), the photoconductor drum 11 first rotates in the direction indicated by the arrow A, and the charging device 12 electrostatically charges the surface of the photoconductor drum 11 to a predetermined polarity (i.e., negative polarity) and potential. Then, the exposure device 13 radiates light onto the electrostatically-charged surface of the photoconductor drum 11 based on an image signal obtained by converting the image information input to the image forming apparatus 1 into the corresponding color component (Y, M, C, or K), thereby forming an electrostatic latent image of the corresponding color component constituted of a predetermined potential difference on the surface.

Subsequently, each of the image forming devices 10 (Y, M, C, and K) performs a developing process by causing the developing roller 141 to supply a toner of the corresponding color (Y, M, C, or K) electrostatically charged to a predetermined polarity (negative polarity) to the electrostatic latent image of the corresponding color component formed on the photoconductor drum 11, so that the toner becomes electrostatically adhered to the electrostatic latent image. As a result of this developing process, the electrostatic latent images of the respective color components formed on the photoconductor drums 11 are made into visible toner images of the four colors (Y, M, C, and K) developed using the toners of the corresponding colors.

Subsequently, when the toner images of the respective colors formed on the photoconductor drums 11 of the image forming devices 10 (Y, M, C, and K) are transported to the first-transfer positions, the first-transfer devices 15 sequentially first-transfer the toner images in a superimposed manner onto the intermediate transfer belt 21 rotating in the direction indicated by the arrow B in the intermediate transfer device 20.

In each image forming device 10 after completing the first-transfer process, the drum cleaning device 16 cleans the surface of the photoconductor drum 11 by scraping and removing extraneous matter therefrom. Thus, the image forming devices 10 become ready for a subsequent image forming operation.

Subsequently, the intermediate transfer device 20 rotates the intermediate transfer belt 21 so as to carry and transport the first-transferred toner images to the second-transfer position. On the other hand, the sheet feed device 50 delivers a predetermined recording sheet 5 to the sheet transport path 56 in accordance with the image forming operation. In the sheet transport path 56, the pair of sheet transport rollers 54 as registration rollers delivers and supplies the recording sheet 5 to the second-transfer position in accordance with the transfer timing.

At the second-transfer position, the second-transfer device 30 collectively second-transfers the toner images on the intermediate transfer belt 21 onto the recording sheet 5. In the intermediate transfer device 20 after completing the second-transfer process, the belt cleaning device 27 cleans the surface of the intermediate transfer belt 21 after the second-transfer process by removing extraneous matter, such as residual toner, from the surface.

Subsequently, the recording sheet 5 having the toner images second-transferred thereon is separated from the intermediate transfer belt 21 and the second-transfer roller 31 and is then transported to the fixing device 40 via the transport guides 57 and 58. In the fixing device 40, the recording sheet 5 that has undergone the second-transfer process is introduced to and passed through the contact area between the heating rotatable member 41 and the pressing rotatable member 42 so as to undergo a predetermined fixing process (heating and pressing), whereby the unfixed toner images becomes fixed onto the recording sheet 5. Finally, the recording sheet 5 that has undergone the fixing process is, for example, output by the pair of sheet output rollers 61 to the sheet output section 60 disposed at the upper portion of the body 1*a* if the image forming operation is for forming an image only on one face of the recording sheet 5.

If images are to be formed on both faces of the recording sheet 5, the recording sheet 5 having the image formed on one face thereof is not output to the sheet output section 60 by the pair of sheet output rollers 61. Instead, the rotational direction of the pair of sheet output rollers 61 is switched to the reverse direction while the pair of sheet output rollers 61 holds the trailing edge of the recording sheet 5. The recording sheet 5 transported in the reverse direction by the pair of sheet output rollers 61 travels above the switch gate 62 and is then transported in an inverted state to the pair of sheet transport rollers 54 via the duplex transport path 63 equipped with, for example, the pair of sheet transport rollers 64 and the transport guides 65 to 68. The pair of sheet transport rollers 54 delivers and supplies the recording sheet 5 to the second-transfer position in accordance with the transfer timing. The recording sheet 5 having an image formed on the reverse face thereof is then output by the pair of sheet output rollers 61 to the sheet output section 60 disposed at the upper portion of the body 1*a*.

As a result of the above operation, a recording sheet 5 having formed thereon a full-color image constituted of a combination of four-color toner images is output.

Configuration of Characteristic Section of Image Forming Apparatus

Every time an image forming operation is executed in the image forming apparatus 1 according to the first exemplary embodiment, the control device 100 accumulatively counts a lifespan parameter, such as the number of rotation of each photoconductor drum 11 or the number of print sheets, and writes the counted lifespan parameter, such as the number of rotation of each photoconductor drum 11 or the number of print sheets, into a memory as an example of an electronic component provided in each process cartridge 80 at a predetermined timing, such as when the image forming operation ends.

In the image forming apparatus 1, the layer thickness of the photoconductor layer of the photoconductor drum 11 in each process cartridges 80 decreases due to, for example, abrasion while the image forming operation proceeds. Therefore, when the process cartridge 80 including the photoconductor drum 11 reaches its lifespan, such as when the layer thickness of the photoconductor layer of the photoconductor drum 11 decreases to a predetermined value, or when the process cartridge 80 including the photoconductor drum 11 is close to reaching its lifespan, the control device 100 detects this state based on the lifespan parameter. Then, the control device 100 causes a display screen of a user interface (not shown) or a personal computer (not shown) connected to the image forming apparatus 1 to display a message prompting the user to replace the process cartridge 80. The user may then replace the process cartridge 80 as an example of an attachable-detachable unit with a new one.

The memory provided in each process cartridge 80 may store predetermined identification information for identifying, for example, the type of developer 4 used in the developing device 14, in addition to the lifespan parameter of the photoconductor drum 11 or together with the lifespan parameter of the photoconductor drum 11.

As shown in FIG. 4, in this exemplary embodiment, each process cartridge 80 includes a customer replaceable unit memory (CRUM) 84 as an example of a memory (electronic component) that stores the lifespan parameter, such as the accumulative number of rotation of the photoconductor drum 11 or the accumulate number of print sheets having images formed thereon by the process cartridge 80, and specific information for identifying, for example, the type of developer 4 used in the developing device 14 and that is used for detecting the lifespan of the photoconductor drum 11. An example of information stored in the CRUM 84 includes information with which the lifespan of the photoconductor drum 11 is detectable. For example, in addition to the accumulative number of rotation of the photoconductor drum 11 or the accumulative number of print sheets, the accumulative number of pixels in image data, an accumulative operation time of the developing device 14, or an accumulative amount of toner supplied to the developing device 14 may be used.

Referring to FIG. 5, when replacing a process cartridge 80, the user may open the side cover (not shown) of the image-forming-apparatus body 1*a*, manually grip the front end of the process cartridge 80 or the handle 82 provided at an intermediate position in the longitudinal direction, and pull out the process cartridge 80 toward the side surface of the image-forming-apparatus body 1*a*, thereby taking the used process cartridge 80 out of the image-forming-apparatus body 1*a*.

Subsequently, a new process cartridge 80 is pushed to a predetermined position within the image-forming-apparatus body 1*a* via the opening 83 of the image-forming-apparatus body 1*a* while being guided by the guide member (not shown), so that the new process cartridge 80 becomes attached to the predetermined position in the image-forming-apparatus body 1*a*.

By being attached to the predetermined position in the image-forming-apparatus body 1*a*, the process cartridge 80 becomes capable of receiving driving force and electric power from the image-forming-apparatus body 1*a*, and the CRUM 84 attached to the process cartridge 80 becomes electrically connected to the control device 100 in the image-forming-apparatus body 1*a*.

As shown in FIG. 4, the process cartridge 80 has the CRUM 84 detachably attached to one longitudinal end at the lower end surface of the process cartridge body 81, that is, the leading end when viewed in the attaching direction of the process cartridge 80. More specifically, the process cartridge body 81 constituted of, for example, the housing 140 of the developing device 14 includes a side cover 85 as an example of a support member that is provided at one longitudinal end of the developing device 14 (in the axial direction of the developing roller 141) and that rotatably supports, for example, the developing roller 141 and the stirring transport members 142 and 143 formed of screw augers. The CRUM 84 is detachably attached to the lower end surface of the side cover 85.

Figure 7:
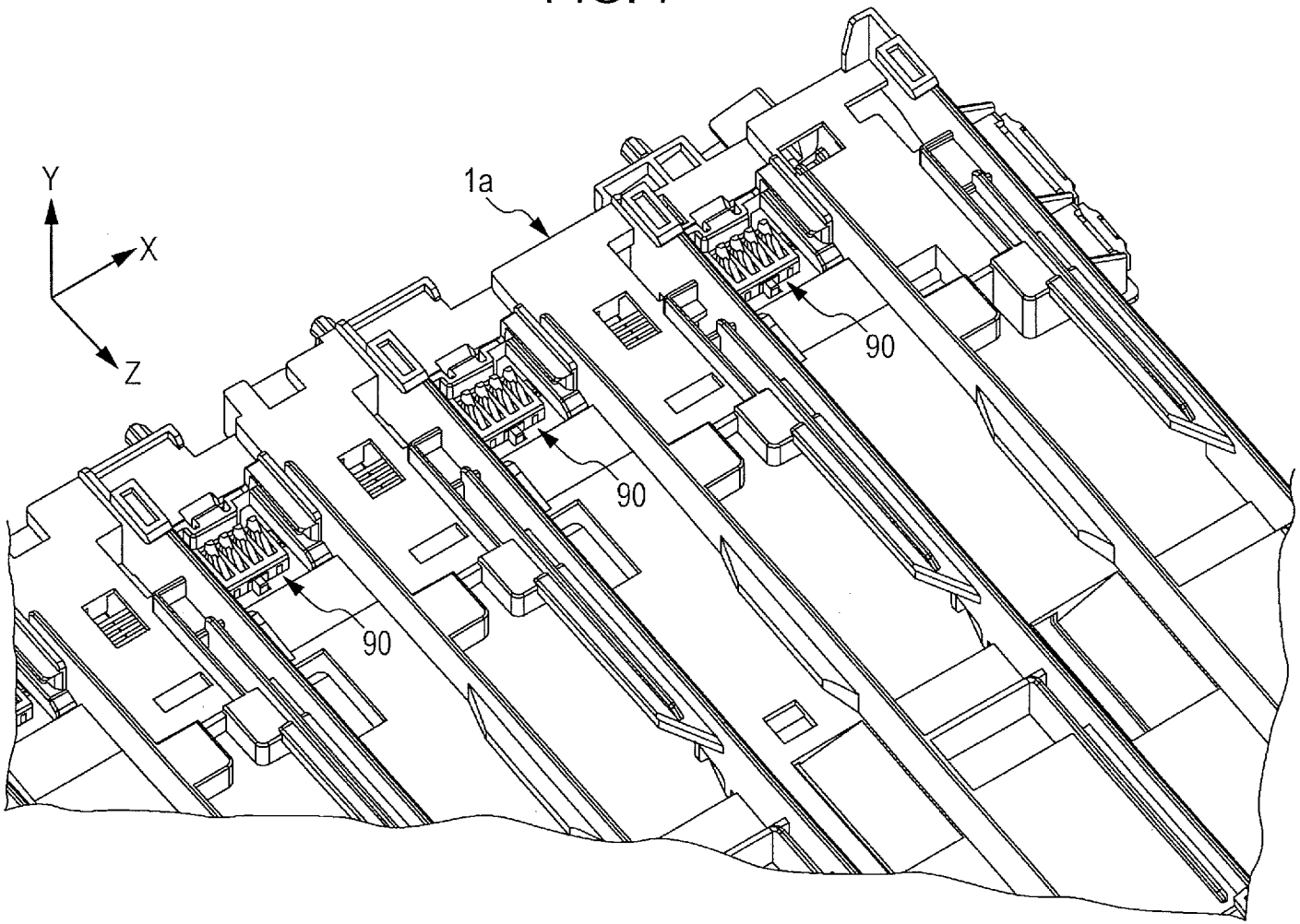
FIG. 7 is a perspective view illustrating connection terminals in the image-forming-apparatus body.

Furthermore, as shown in FIGS. 6 and 7, the image-forming-apparatus body 1*a* includes connector members 90 as an example of connection terminals that are electrically connected to connection electrodes, which will be described later, of the CRUM 84 when the process cartridge 80 is attached to the image-forming-apparatus body 1*a*.

Configuration of Side Cover (Support Member)

Figure 8:
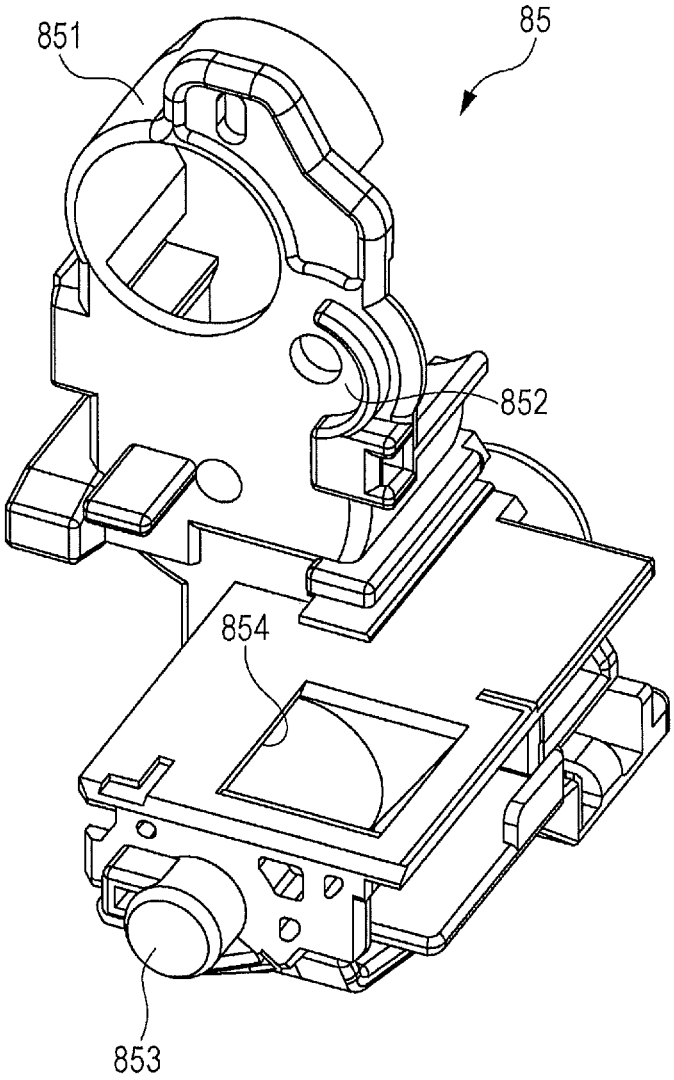
FIG. 8 is a perspective view illustrating a side cover of the process cartridge.
Figure 9:
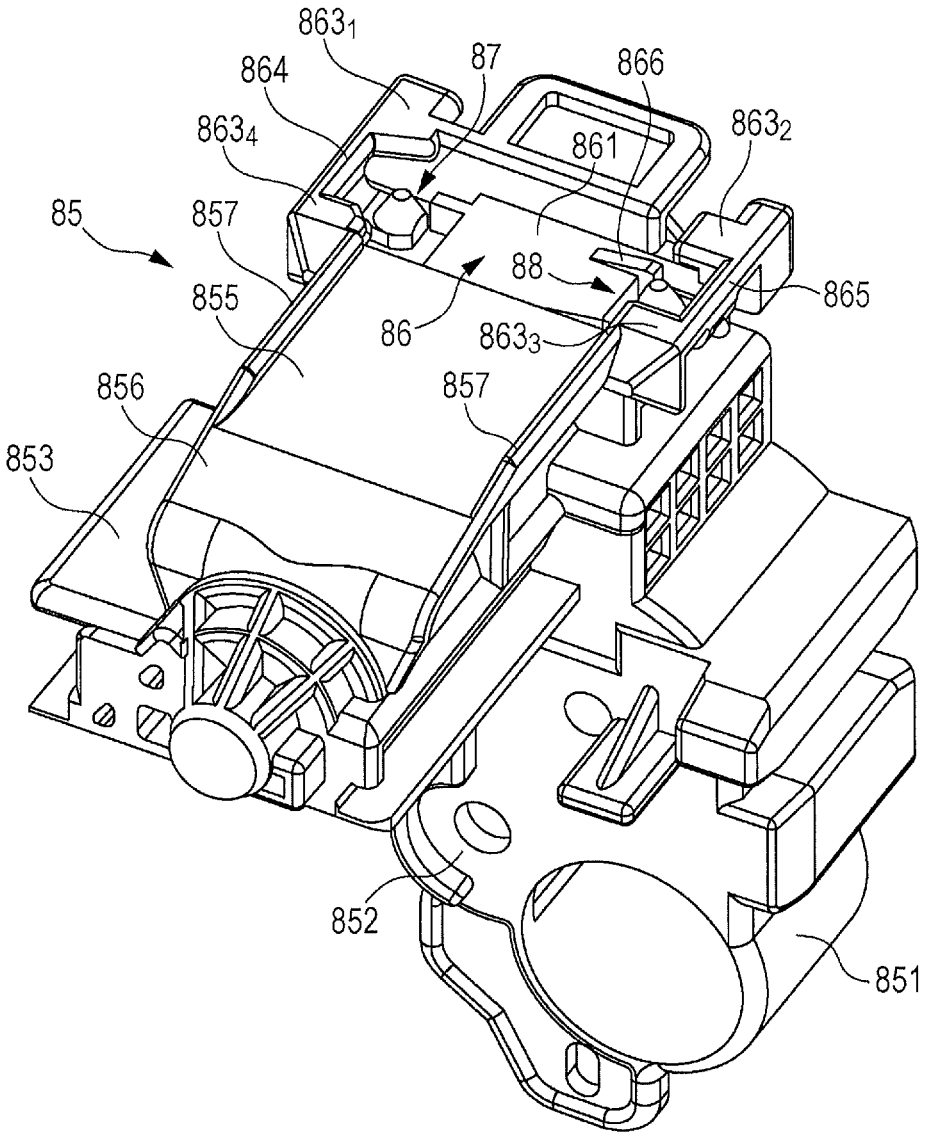
FIG. 9 is another perspective view illustrating the side cover of the process cartridge.
Figure 10:
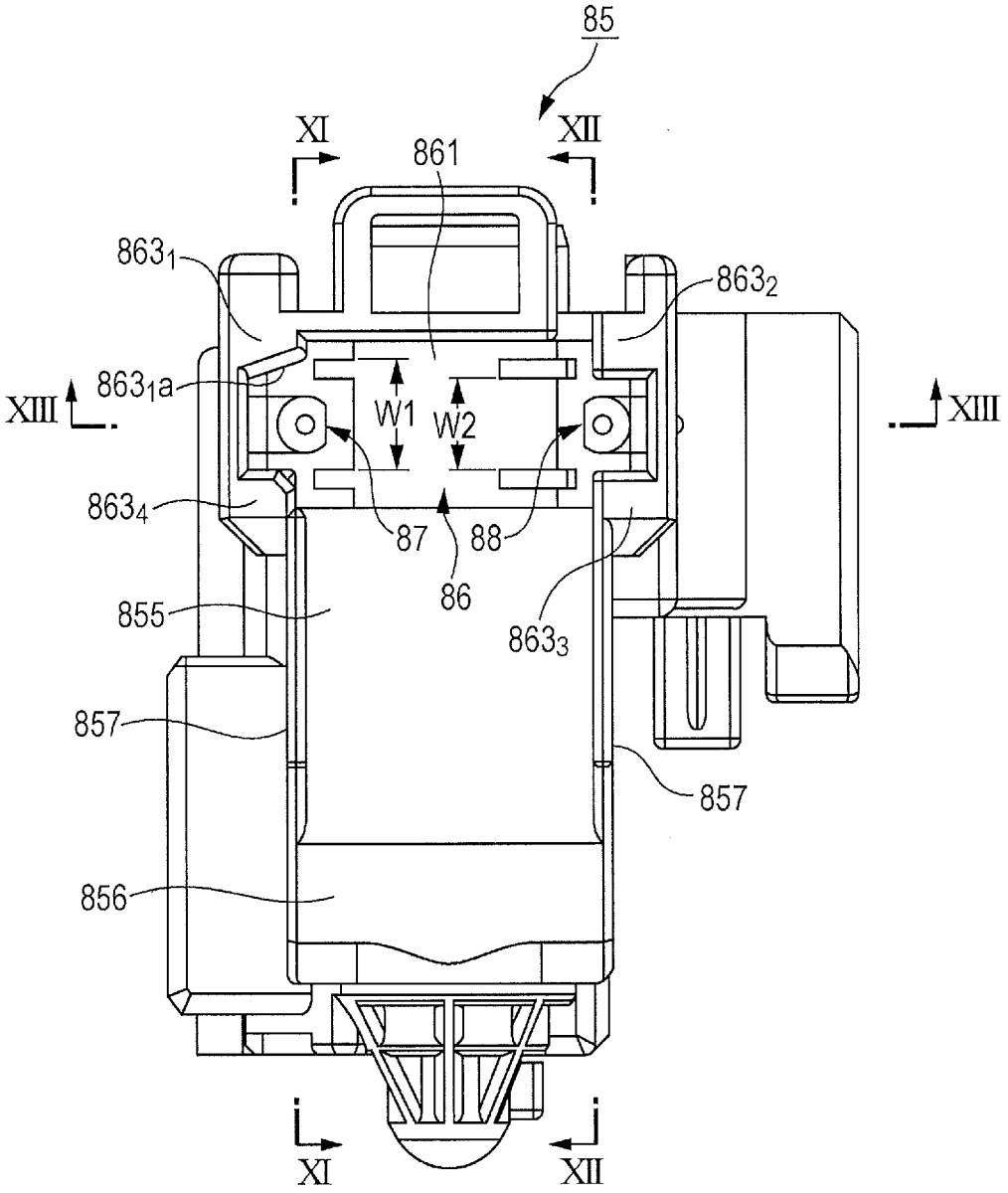
FIG. 10 is a bottom view illustrating the side cover of the process cartridge.
Figure 11:
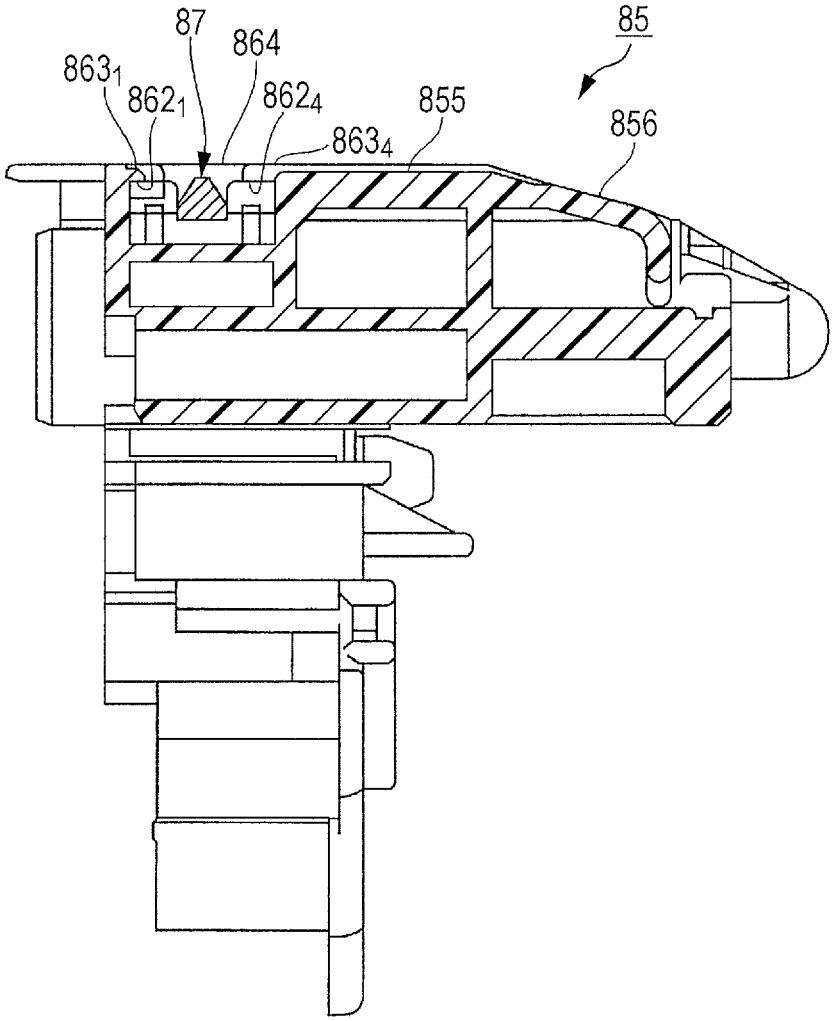
FIG. 11 is a cross-sectional view taken along line XI-XI in FIG. 10.
Figure 12:
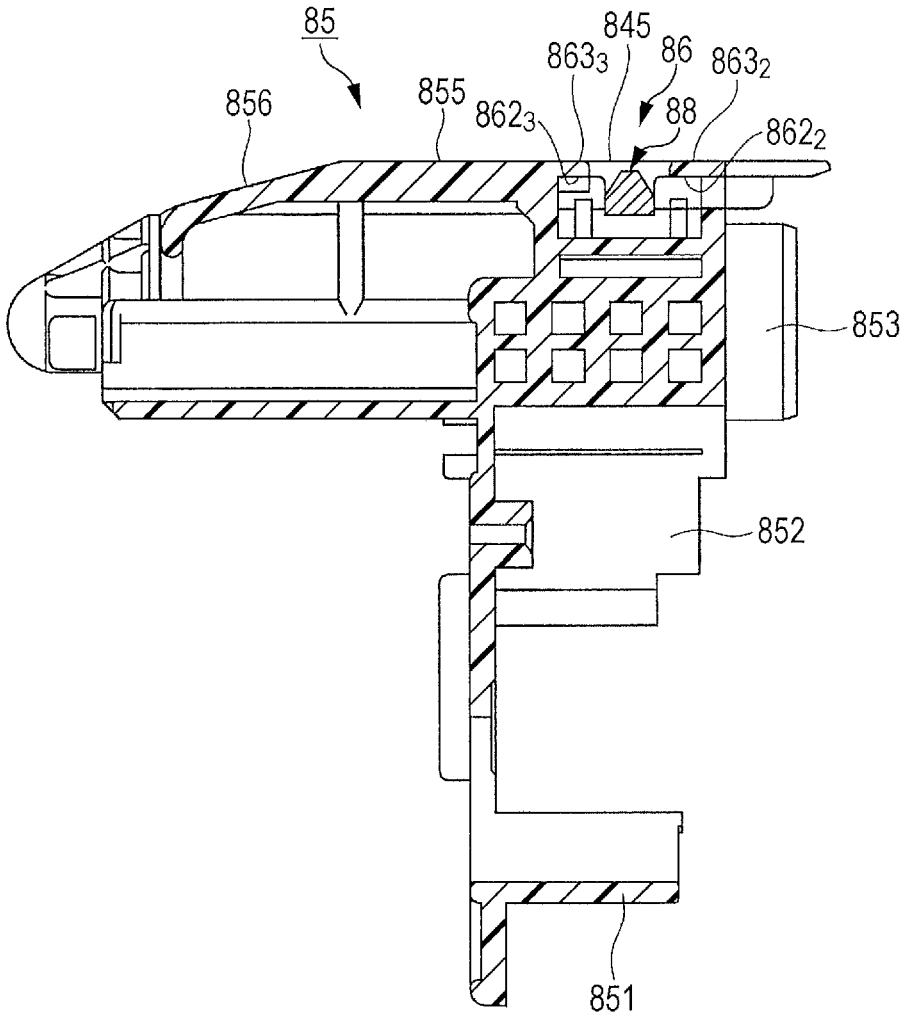
FIG. 12 is a cross-sectional view taken along line XII-XII in FIG. 10.
Figure 13:
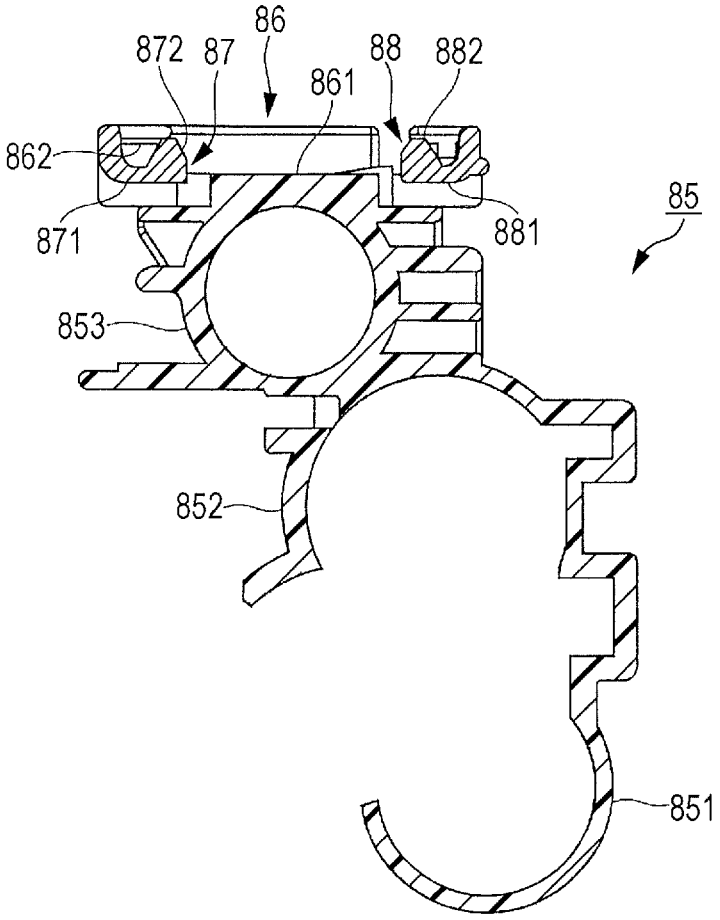
FIG. 13 is a cross-sectional view taken along line XIII-XIII in FIG. 10.

FIG. 8 is a top perspective view illustrating the side cover 85 as an example of a support member to which the electronic-component attachment structure according to the first exemplary embodiment of the present invention is applied. FIG. 9 is a bottom perspective view illustrating the side cover 85. FIG. 10 is a bottom view illustrating the side cover 85. FIG. 11 is a cross-sectional view taken along line XI-XI in FIG. 10. FIG. 12 is a cross-sectional view taken along line XII-XII in FIG. 10. FIG. 13 is a cross-sectional view taken along line XIII-XIII in FIG. 10.

The side cover 85 is integrally formed using, for example, synthetic resin. As shown in FIGS. 3 and 4, the side cover 85 is attached to one longitudinal end of the developing device 14 in the process cartridge 80 by being, for example, fitted thereto or screwed thereto. As shown in FIGS. 8 and 9, the side cover 85 includes a cylindrical first shaft support 851 that rotatably supports one axial end of the developing roller 141, a second shaft support 852 that rotatably supports the stirring transport member 142 formed of, for example, a screw auger, and a third shaft support 853 that rotatably supports the stirring transport member 143 formed of, for example, a screw auger. An end surface of the first shaft support 851 has an opening for transmitting driving force from the image-forming-apparatus body 1*a* to the developing roller 141. As shown in FIG. 8, the third shaft support 853 of the side cover 85 has a rectangular supply port 854 that receives a developer at least containing a toner supplied from the corresponding toner cartridge 145 (Y, M, C, or K). The supply port 854 is normally closed by a shutter member (not shown).

As shown in FIG. 9, a bottom surface 855 of the side cover 85 is a flat surface. The side cover 85 has an attaching section 86 for detachably attaching the CRUM 84 at the inner side of the bottom surface 855 in the axial direction, that is, at the trailing end in the attaching direction of the process cartridge 80. As shown in FIG. 10, the attaching section 86 has a recess with a rectangular shape in plan view. The upper end surface of the attaching section 86 has an opening for attaching the CRUM 84. A bottom surface 861 of the attaching section 86 is formed to be one step lower than the bottom surface 855 of the side cover 85. The bottom surface 855 of the side cover 85 is provided with a guide surface 856 for guiding the connector members 90 in the image-forming-apparatus body 1*a* at the outer side of the bottom surface 855 in the axial direction, that is, at the leading end in the attaching direction of the process cartridge 80. The guide surface 856 is disposed in an inclined state such that the distal end thereof decreases in height. Furthermore, the bottom surface 855 of the side cover 85 has low sidewalls 857 at opposite sides thereof in the direction intersecting the attaching direction. Although a surface located at the lower side in FIGS. 9, 10, and so on is referred to as a bottom surface for the sake of convenience, such a surface in actuality is a surface located at the upper side of the attaching section 86 since FIGS. 9, 10, and so on are bottom views of the side cover 85.

Figure 14A:
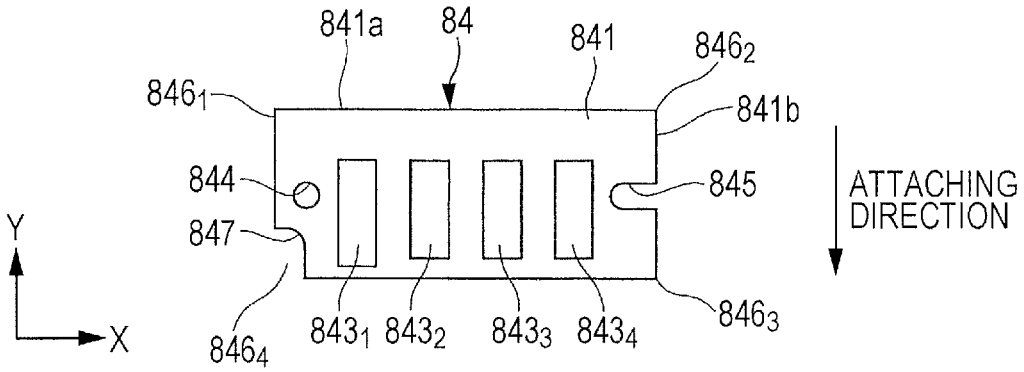
FIG. 14A is a plan view illustrating a customer replaceable unit memory (CRUM)
Figure 14B:
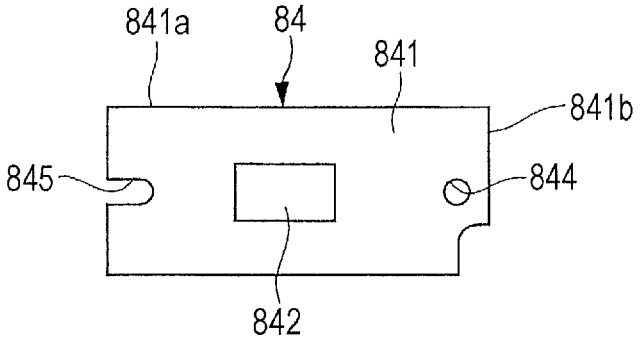
FIG. 14B is a back view illustrating the CRUM.
Figure 14C:
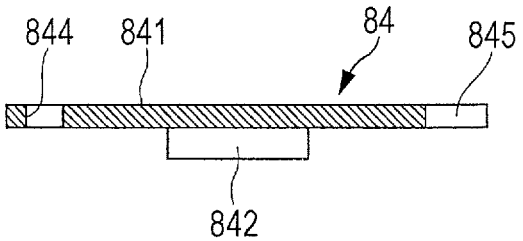
FIG. 14C is a cross-sectional view illustrating the CRUM.

As shown in FIGS. 14A to 14C, the CRUM 84 includes an integrated-circuit (IC) substrate 841 formed of a printed circuit substrate as an example of a substrate having a substantially rectangular shape in plan view. One surface (i.e., an undersurface) of the IC substrate 841 has mounted therein an electrically erasable programmable read-only memory (EEPROM) 842 which is a readable-writable non-volatile memory as an example of an integrated circuit. The other surface (i.e., a top surface) of the IC substrate 841 is provided with multiple (four in the example shown in FIGS. 14A to 14C) connection electrodes $\mathbf{843}_1$ to $\mathbf{843}_4$ respectively connected to multiple terminals (not shown) of the EEPROM 842. The connection electrodes $\mathbf{843}_1$ to $\mathbf{843}_4$ are exposed to the outside in an externally contactable state and are respectively connected to, for example, a GND terminal, a CLK terminal, a VCC terminal, and a DATA terminal of the EEPROM 842. Although four connection electrodes $\mathbf{843}_1$ to $\mathbf{843}_4$ are provided for the EEPROM 842 in the exemplary embodiment shown in FIGS. 14A to 14C, the number of connection electrodes $\mathbf{843}_1$ to $\mathbf{843}_4$ is not limited to four, and may alternatively be three or smaller or five or larger. The number of electrode terminals of the EEPROM 842 and the number of connection electrodes $\mathbf{843}_1$ to $\mathbf{843}_4$ do not necessarily have to be the same. The number of connection electrodes $\mathbf{843}_1$ to $\mathbf{843}_4$ may be smaller than the number of electrode terminals of the EEPROM 842.

Accordingly, the CRUM 84 is a replaceable electronic component equipped with the EEPROM 842, which is a nonvolatile memory. The four connection electrodes $\mathbf{843}_1$ to $\mathbf{843}_4$ of the IC substrate 841 each have a narrow rectangular shape extending in an attaching direction Y (i.e., a second direction) of the process cartridge 80 and are arranged parallel to one another with a predetermined distance therebetween in an X direction (i.e., a first direction) that intersects the attaching direction Y. The IC substrate 841 has long edges 841*a* that are relatively long in the arranged direction X of the connection electrodes $\mathbf{843}_1$ to $\mathbf{843}_4$ and short edges 841*b* that are relatively short in the Y direction intersecting the arranged direction X. Of the four connection electrodes $\mathbf{843}_1$ to $\mathbf{843}_4$, the GND electrode $\mathbf{843}_1$ disposed at one end protrudes toward the leading end in the attaching direction Y and is longer than the remaining electrodes $\mathbf{843}_2$ to $\mathbf{843}_4$. Therefore, when attaching the process cartridge 80 to the image-forming-apparatus body 1*a*, the GND electrode $\mathbf{843}_1$ of the CRUM 84 first comes into contact with and becomes connected to the corresponding connector member 90 in the image-forming-apparatus body 1*a*, and the remaining electrodes $\mathbf{843}_2$ to $\mathbf{843}_4$ subsequently come into contact with and become connected to the corresponding connector members 90 in the image-forming-apparatus body 1*a*.

As shown in FIGS. 14A to 14C, the IC substrate 841 of the CRUM 84 is provided with first and second positioning portions 844 and 845 that are disposed at the center of ends opposite each other in the extending direction of the long edges 841*a* and that are for positionally fixing the IC substrate 841 to the attaching section 86 of the side cover 85. The first positioning portion 844 of the IC substrate 841 is provided at the center of one of the short edges 841*b* of the IC substrate 841 and is formed of a circular through-hole extending through the IC substrate 841. The second positioning portion 845 is provided at the center of the other short edge 841*b* located at the opposite side in the extending direction of the long edges 841*a* of the IC substrate 841 and is formed of a recessed notch whose opening faces toward the short edge 841*b*. In the exemplary embodiment shown in FIGS. 14A to 14C, the diameter of the first positioning portion 844 and the opening width of the second positioning portion 845 are set to the same value. The through-hole 844 in the IC substrate 841 functions as a first positioning portion for positioning the IC substrate 841 in the X direction, which is the extending direction of the long edges 841*a*. The recessed notch 845 in the IC substrate 841 functions as a second positioning portion for positioning the IC substrate 841 in the Y direction, which is the extending direction of the short edges 841*b*. Of four corners $\mathbf{846}_1$ to $\mathbf{846}_4$ of the IC substrate 841, the corner $\mathbf{846}_4$ is provided with a cutout 847 as a clearance portion for facilitating the attachment of the side cover 85 to the attaching section 86. The attaching section 86 of the side cover 85 has enough depth for accommodating the EEPROM 842 of the IC substrate 841 when the CRUM 84 is attached thereto.

As shown in FIGS. 9, 11, 12, and 13, the attaching section 86 of the side cover 85 has four attachment surfaces $\mathbf{862}_1$ to $\mathbf{862}_4$ that support the surface of the IC substrate 841 of the CRUM 84 while being in abutment therewith such that the connection electrodes $\mathbf{843}_1$ to $\mathbf{843}_4$ of the CRUM 84 are connectable from the outside (i.e., from the lower surface of the process cartridge 80) when the CRUM 84 is attached.

The attachment surfaces $862_1$ to $862_4$ are provided in correspondence with the four corners $846_1$ to $846_4$ of the IC substrate 841. In FIG. 9, reference sign "866" denotes a guide slope surface that is provided at the bottom surface 861 of the attaching section 86 and that guides the undersurface of the IC substrate 841 of the CRUM 84 to the attachment surfaces $862_2$ and $862_3$ when the CRUM 84 is being attached to the attaching section 86.

More specifically, as shown in FIG. 10, the attaching section 86 of the side cover 85 has four frame portions $863_1$ to $863_4$ protruding inwardly to four corners of the attaching section 86 in correspondence with the four corners $846_1$ to $846_4$ of the IC substrate 841. The undersurfaces of these four frame portions $863_1$ to $863_4$, that is, inner surfaces facing the bottom surface 861 of the attaching section 86, serve as the attachment surfaces $862_1$ to $862_4$. As shown in FIG. 10, one side surface $863_{1a}$ of the first frame portion $863_1$ among the four frame portions $863_1$ to $863_4$ is inclined for facilitating the attachment and detachment of the CRUM 84. As a result, an opening width W1 between the first frame portion $863_1$ and the fourth frame portion $863_4$ is set to be larger than the other opening width W2. The three remaining frame portions $863_2$ to $863_4$ are rectangular in plan view in correspondence with the three corners $846_2$ to $846_4$ of the IC substrate 841.

Of the attachment surfaces $862_1$ to $862_4$ provided at four locations, the fourth attachment surface $862_4$ is provided in correspondence with the cutout 847 of the IC substrate 841 for facilitating the attachment of the CRUM 84 to the attaching section 86 and serves as a dummy attachment surface that is not actually used for the attachment of the IC substrate 841.

Furthermore, as shown in FIG. 10, the attaching section 86 of the side cover 85 has two snap joint portions 87 and 88 as an example of cantilevered positioning supporters at positions corresponding to opposite longitudinal ends of the IC substrate 841 of the CRUM 84. The snap joint portions 87 and 88 elastically deform by being relatively joined (coupled) to the first and second positioning portions 844 and 845 provided in the IC substrate 841, and position and support the IC substrate 841 at predetermined attachment positions of the attachment surfaces $862_1$ to $862_4$ with restoring force generated as a result of the elastic deformation. The two snap joint portions 87 and 88 have identical configurations.

Figure 15A:
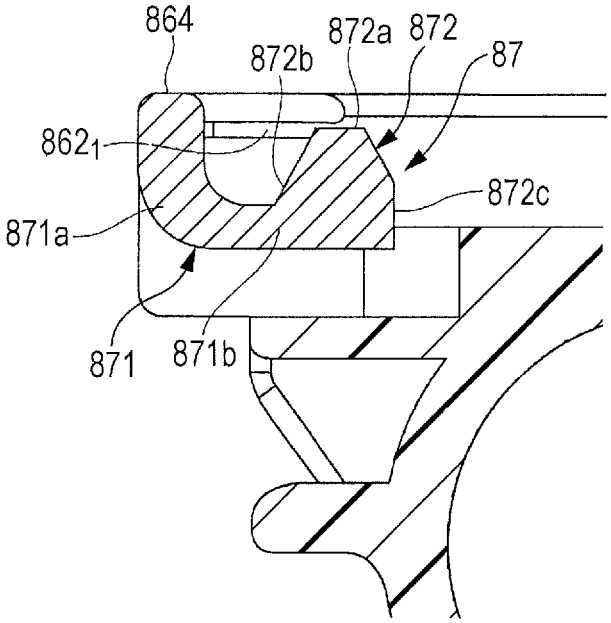
FIGS. 15A and 15B are enlarged cross-sectional views each illustrating a relevant part of the side cover of the process cartridge.
Figure 15B:
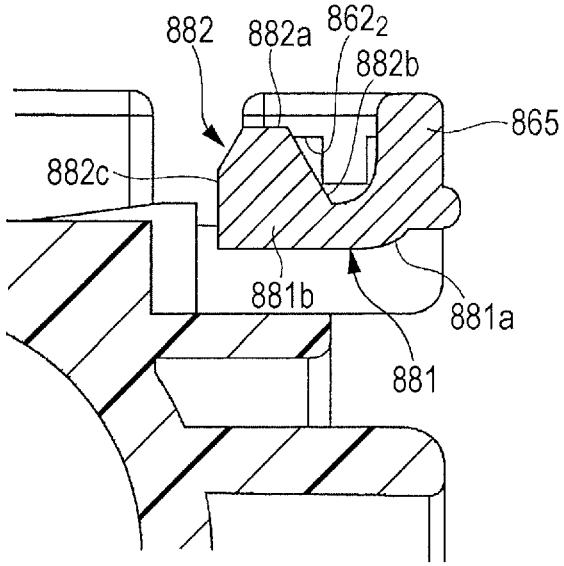

As shown in FIGS. 9, 10, 11, 12, and 13, the snap joint portions 87 and 88 are integrally provided at the lower end surfaces of connection portions 864 and 865 that are substantially rectangular in cross section and that connect between the first frame portion $863_1$ and the fourth frame portion $863_4$ and between the second frame portion $863_2$ and the third frame portion $863_3$, respectively. As shown in FIG. 13, the snap joint portions 87 and 88 respectively include arm portions 871 and 881 integrally formed at the lower end surfaces of the connection portions 864 and 865 and extending toward the inner periphery of the attaching section 86, and third and fourth positioning portions 872 and 882 extending upward from the tip ends of the arm portions 871 and 881. As shown in FIGS. 15A and 15B, the arm portions 871 and 881 of the snap joint portions 87 and 88 have base ends 871*a* and 881*a* and tip ends 871*b* and 881*b*, respectively. The base ends 871*a* and 881*a* are bent into a substantially arc shape from the lower end surfaces of the connection portions 864 and 865 toward the inner side of the attaching section 86. The tip ends 871*b* and 881*b* have a flat shape and are disposed parallel to the bottom surface 861 of the attaching section 86. The third and fourth positioning portions 872 and 882 of the snap joint portions 87 and 88 each have a substantially circular truncated cone shape with a narrowed end. Furthermore, flat-circular-shaped tip end surfaces 872*a* and 882*a* of the third and fourth positioning portions 872 and 882 have diameters smaller than those of the first and second positioning portions 844 and 845 of the IC substrate 841, whereas bottom surfaces 872*b* and 882*b* of the third and fourth positioning portions 872 and 882 have diameters larger than that of the first positioning portion 844. Furthermore, the third and fourth positioning portions 872 and 882 have inner side surfaces 872*c* and 882*c* that are flat. The shape of the third and fourth positioning portions 872 and 882 is not limited to the substantially circular truncated cone shape and may alternatively be any shape, such as an angular truncated cone shape or an ellipsoidal shape, so long as the shape allows the third and fourth positioning portions 872 and 882 to be positioned by being joined to the first and second positioning portions 844 and 845. Moreover, the terms such as "upper" and "lower end surfaces" used here refer to the up-down direction in the drawings and are different from the up-down direction in actuality.

Figure 16:
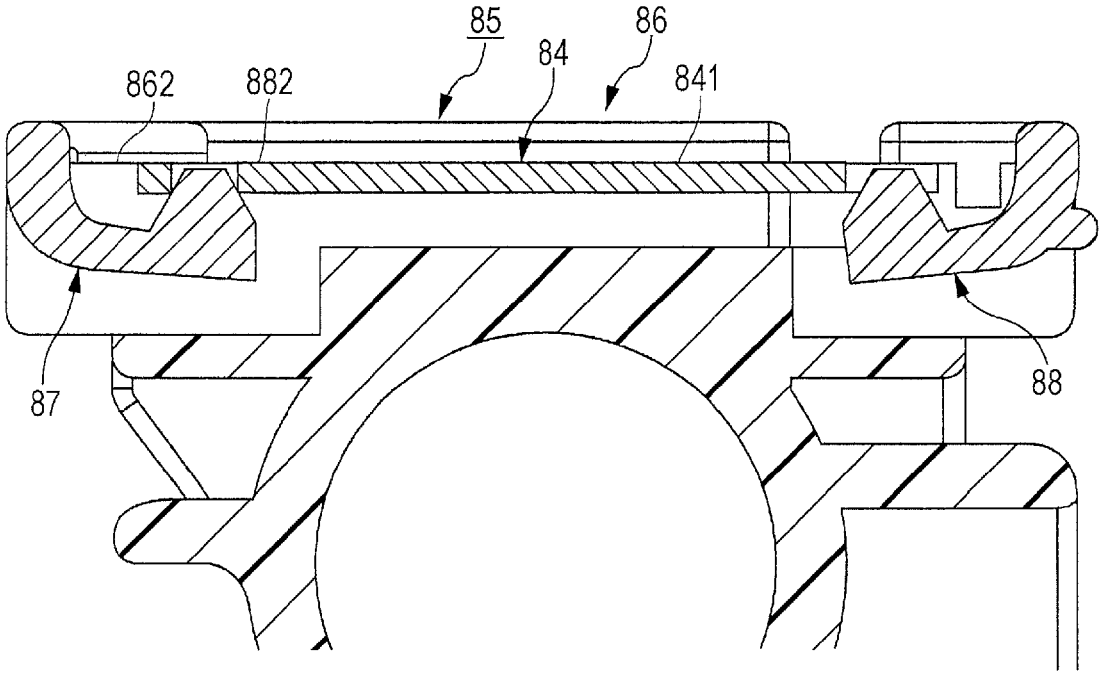
FIG. 16 is a cross-sectional view illustrating a state where the CRUM is attached to the side cover of the process cartridge.

As shown in FIG. 16, with regard to the snap joint portions 87 and 88, the arm portions 871 and 881 elastically deform as a result of the third and fourth positioning portions 872 and 882 being joined to the first and second positioning portions 844 and 845 of the IC substrate 841. Due to restoring force generated as a result of the elastic deformation of the arm portions 871 and 881, the snap joint portions 87 and 88 position and support the IC substrate 841 while pressing the IC substrate 841 against the attachment surfaces $862_1$ to $862_4$. The restoring force generated as a result of the elastic deformation of the snap joint portions 87 and 88 is set based in the widths and the thicknesses of the arm portions 871 and 881, as well as the synthetic resin material used for forming the side cover 85. In this exemplary embodiment, the restoring force generated as a result of the elastic deformation of the snap joint portions 87 and 88 is set to a value larger than pressing force received from the connector members 90 in the image-forming-apparatus body 1*a*.

Figure 17:
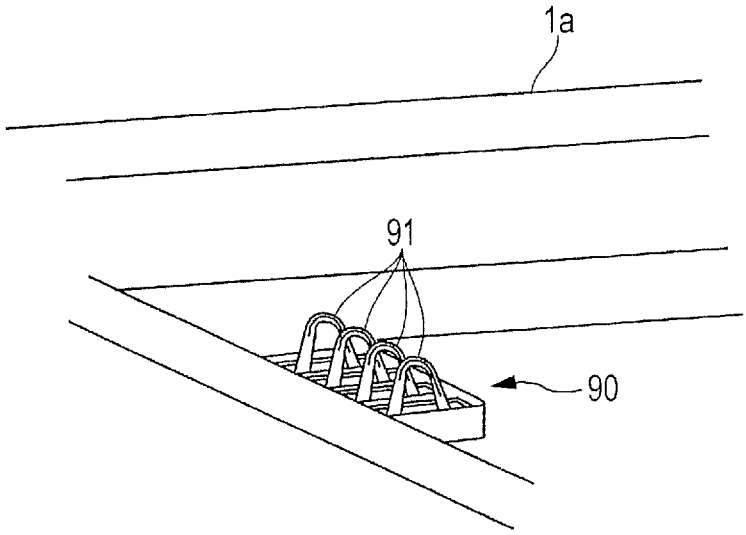
FIG. 17 is a perspective view illustrating connection terminals in the image-forming-apparatus body.

FIG. 17 is an enlarged view illustrating a connection terminal area in the image-forming-apparatus body 1*a*.

Figure 18:
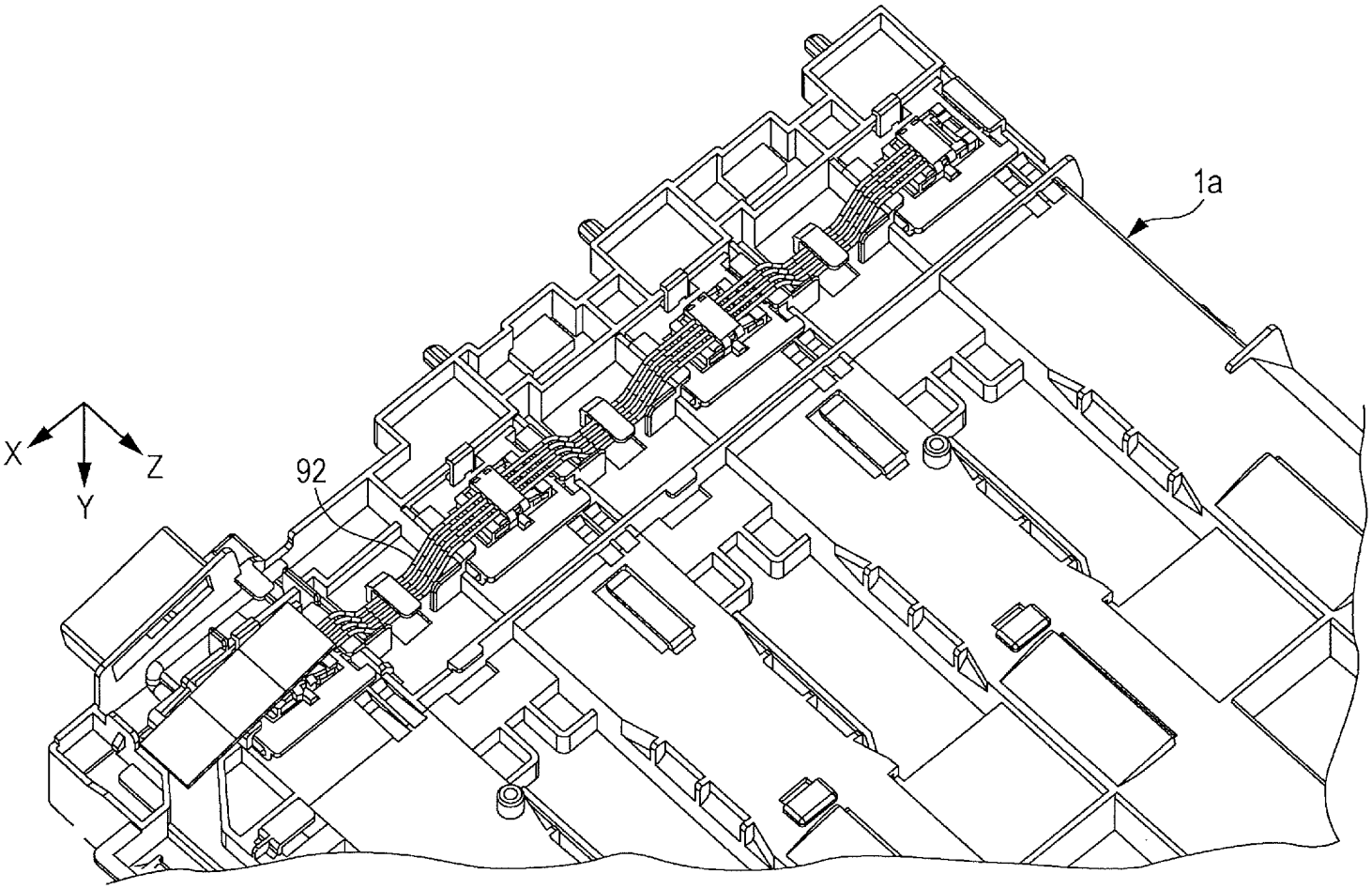
FIG. 18 is a perspective view illustrating the underside of the connection terminals in the image-forming-apparatus body.

In FIG. 17, each connector member 90 as an example of a connection section in the body 1*a* is supported at the left side of the rear end of a cartridge supporter in the image-forming-apparatus body 1*a*. The connector member 90 in the body 1*a* has upwardly-protruding connector terminals 91 as an example of connection terminals. The connector terminals 91 are each formed of an elastically-deformable plate-spring-shaped metallic material. As shown in FIG. 18, the connector members 90 in the body 1*a* are electrically connected to the control device 100 of the image-forming-apparatus body 1*a* via multiple harnesses 92 as an example of transmission lines.

Operation of Characteristic Section of Image Forming Apparatus

In the image forming apparatus 1 to which the electronic-component attachment structure and the attachable-detachable unit according to this exemplary embodiment are applied, each process cartridge 80 is replaced in the following manner.

As shown in FIG. 6, the process cartridge 80 is attached to a predetermined position in the image-forming-apparatus body 1*a* so that the connection electrodes $843_1$ to $843_4$ of the CRUM 84 attached to the process cartridge 80 become electrically connected to the connector terminals 91 of the corresponding connector member 90 provided in the image-forming-apparatus body 1*a*, whereby information related to, for example, the lifespan of the photoconductor drum 11 stored in the CRUM 84 becomes readable and writable by the control device 100 via the connector member 90. Based on the information related to, for example, the lifespan of the photoconductor drum 11 stored in the CRUM 84, if the control device 100 determines that a predetermined replacement condition is satisfied, such as the layer thickness of the photoconductor layer of the photoconductor drum 11 decreasing to a predetermined value, the control device 100 causes a display screen of a user interface (not shown) or a personal computer (not shown) connected to the image forming apparatus 1 to display a message prompting the user to replace the process cartridge 80. As shown in FIG. 5, when replacing the process cartridge 80, the used process cartridge 80 is pulled out toward the right side surface of the image forming apparatus 1 in a state where a front cover (not shown) of the image forming apparatus 1 is open, and the used process cartridge 80 is removed from the image-forming-apparatus body 1*a*.

In this case, the connection electrodes $\mathbf{843}_1$ to $\mathbf{843}_4$ in the IC substrate 841 of the CRUM 84 provided in the process cartridge body 81 become separated and detached from the connector terminals 91 in the image-forming-apparatus body 1*a* as the process cartridge 80 moves.

Subsequently, a new process cartridge 80 is attached to the predetermined position within the image-forming-apparatus body 1*a* via the opening 83 provided in the right side surface of the image-forming-apparatus body 1*a*. In accordance with this attaching operation of the new process cartridge 80, the connection electrodes $\mathbf{843}_1$ to $\mathbf{843}_4$ in the IC substrate 841 of the CRUM 84 provided in the process cartridge 80 become connected to the connector terminals 91 in the image-forming-apparatus body 1*a*. Then, the cover (not shown) of the image forming apparatus 1 is closed.

Figure 19A:
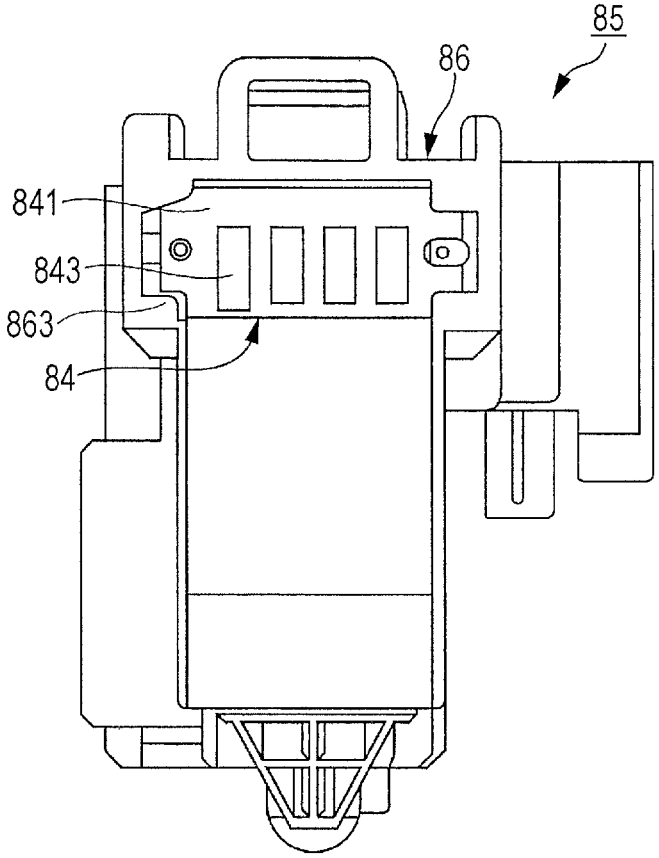
FIG. 19A is a bottom view illustrating a state where the CRUM is attached to the side cover of the process cartridge.
Figure 19B:
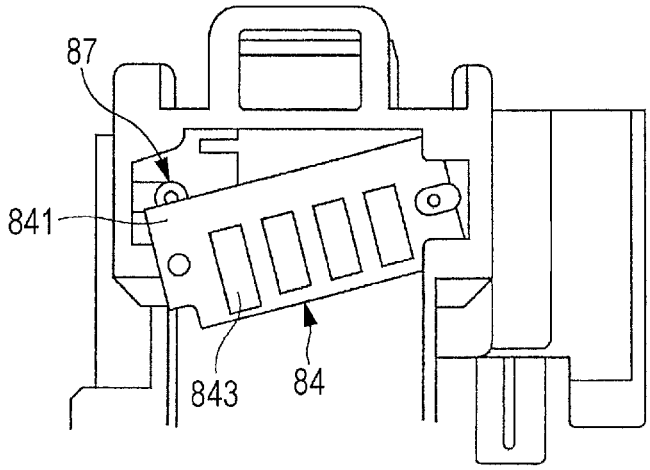
FIG. 19B is a bottom view illustrating a relevant part of the CRUM being attached to the side cover of the process cartridge.

As shown in FIGS. 19A and 19B, the CRUM 84 is attached to the process cartridge 80 by attaching the IC substrate 841 of the CRUM 84 to the attaching section 86 provided in the side cover 85 of the process cartridge 80.

Figure 20:
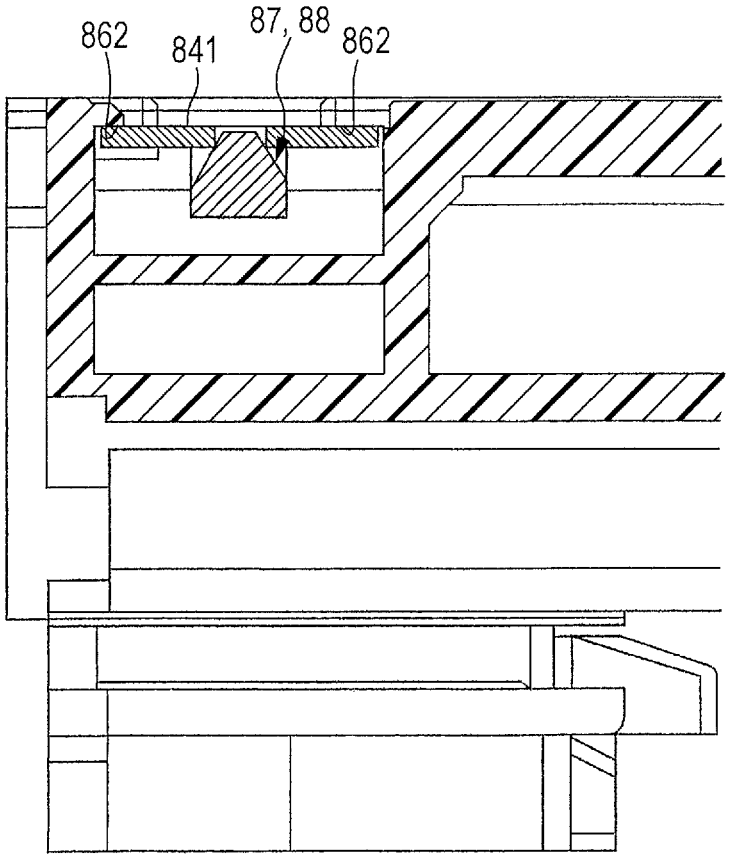
FIG. 20 is a cross-sectional view illustrating a state where the CRUM is attached to the side cover of the process cartridge.

As shown in FIG. 19B, in order to attach the IC substrate 841 of the CRUM 84 to the attaching section 86 of the side cover 85, the IC substrate 841 set in a tilted state is fitted to the attaching section 86 of the side cover 85, and the second positioning portion 845 of the IC substrate 841 is inserted to the fourth positioning portion 882 of the snap joint portion 88 of the attaching section 86. In addition, the surface of the second corner $\mathbf{846}_2$ of the IC substrate 841 is brought into abutment with the second attachment surface $\mathbf{862}_2$ of the attaching section 86, and the surface of the third corner $\mathbf{846}_3$ of the IC substrate 841 is brought into abutment with the third attachment surface $\mathbf{862}_3$ of the attaching section 86. In this state, the undersurface of the IC substrate 841 is brought into contact with the third positioning portion 872 of the other snap joint portion 87 of the attaching section 86, and the first corner $\mathbf{846}_1$ of the IC substrate 841 is rotated clockwise while the IC substrate 841 is pushed toward the bottom surface 861 of the attaching section 86 so that the surface of the first corner $\mathbf{846}_1$ of the IC substrate 841 is brought into abutment with the first attachment surface $\mathbf{862}_1$ of the attaching section 86. Accordingly, as shown in FIG. 20, the surfaces of the first to third corners $\mathbf{846}_1$ to $\mathbf{846}_3$ of the IC substrate 841 are brought into abutment with the first to third attachment surfaces $\mathbf{862}_1$ to $\mathbf{862}_3$ of the attaching section 86, respectively, and the first positioning portion 844 of the IC substrate 841 is joined (coupled) to the third positioning portion 872 of the snap joint portion 87 of the attaching section 86, whereby the IC substrate 841 becomes positioned and supported while being in contact with predetermined attachment positions of the attachment surfaces $\mathbf{862}_1$ to $\mathbf{862}_3$ provided in the attaching section 86 of the side cover 85.

In order to detach the IC substrate 841 of the CRUM 84 from the attaching section 86 of the side cover 85, the reverse procedure is performed. Specifically, the snap joint portion 87 is elastically deformed by using a tool, such as a driver (not shown), and the first corner $\mathbf{846}_1$ of the IC substrate 841 is rotated counterclockwise in FIG. 19B while releasing the joined state between the first positioning portion 844 of the IC substrate 841 and the third positioning portion 872 of the snap joint portion 87 of the attaching section 86, whereby the IC substrate 841 becomes detached from the attaching section 86 of the side cover 85.

Accordingly, in the above exemplary embodiment, the connector terminals 91 of the connector member 90 provided in the image-forming-apparatus body 1*a* are electrically connected, from the outside, to the connection electrodes $\mathbf{843}_1$ to $\mathbf{843}_4$ exposed on the surface of the IC substrate 841 of the CRUM 84 without having to increase the number of components, as compared with a configuration in which a second protection connection terminal is electrically connected to a connection terminal of an image-forming-apparatus body.

Although the image forming apparatus 1 described in the above exemplary embodiment is directed to a full-color image forming apparatus equipped with image forming devices corresponding to the yellow (Y), magenta (M), cyan (C), and black (K) colors, the exemplary embodiment is not limited to such an image forming apparatus and may alternatively be applied to a monochromatic image forming apparatus.

Furthermore, although the CRUM 84 is used as an example of an electronic component in the above exemplary embodiment, the exemplary embodiment is not limited to this. The electronic component may alternatively be of a type equipped with a substrate having another type of IC circuit mounted therein.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electronic-component attachment structure comprising:

an electronic component having a connection electrode exposed on a surface of a substrate; and a support member that supports the substrate of the electronic component in abutment with an attachment surface so as to allow the connection electrode to be externally connectable, the support member having a positioning supporter that elastically deforms by being relatively joined to a positioning portion provided in the substrate and that positions and supports the substrate to the attachment surface with restoring force generated as a result of the elastic deformation, the positioning portion comprising a circular through-hole and the positioning supporter including an arm portion that elastically deforms and another circular through-hole, the another positioning portion not facing the attachment surface and an area over the another positioning portion being open upward from the substrate of the electronic component is being attached to the attachment surface.

2. The electronic-component attachment structure according to claim 1, wherein the substrate of the electronic component is substantially rectangular in plan view, wherein the attachment surface includes at least three attachment surfaces provided in correspondence with three corners excluding one corner of the substantially rectangular substrate, and wherein the substrate is in abutment with the three attachment surfaces.

3. The electronic-component attachment structure according to claim 1, wherein the substrate of the electronic component is rectangular in shape and has an attachment clearance portion that is located at a position corresponding to one corner not in abutment with the attachment surface and that is formed of a cutout for attaching the substrate to the attachment surface.

4. The electronic-component attachment structure according to claim 1, wherein a surface of the support member located at a side of the connection electrode of the electronic component is open for attaching the substrate of the electronic component to the attachment surface.

5. The electronic-component attachment structure according to claim 1, wherein the connection electrode of the electronic component includes a plurality of connection electrodes arranged in a first direction, and wherein the substrate has the positioning supporter at a center of ends opposite each other in the first direction.

6. The electronic-component attachment structure according to claim 1, wherein the arm portion comprises a base end that is bent into a substantially arc shape from a lower end surface and toward an inner side of a connection portion of the positioning supporter.

7. The electronic-component attachment structure according to claim 1, wherein the arm portion comprises a base end that is bent into a substantially arc shape with a tip end having a flat shape and disposed parallel to a bottom surface of the attachment surface.

8. An attachable-detachable unit comprising:

an attachable-detachable-unit body that is attachable to and detachable from an image-forming-apparatus body;

an electronic component that is attached to the attachable-detachable-unit body and that has a connection electrode exposed on a surface of a substrate; and a support member that supports the substrate of the electronic component in abutment with an attachment surface so as to allow the connection electrode to be externally connectable, the support member having a positioning supporter that elastically deforms by being relatively joined to a positioning portion provided in the substrate and that positions and supports the substrate to the attachment surface with restoring force generated as a result of the elastic deformation, the positioning portion comprising a circular through-hole and the positioning supporter including an arm portion that elastically deforms and another positioning portion extending upward from a tip end of the arm portion and inserted into the circular through-hole, the another positioning portion not facing the attachment surface and an area over the another positioning portion being open upward from the substrate of the electronic component and configured to allow passage therethrough when the substrate of the electronic component is being attached to the attachment surface.

9. An image forming apparatus comprising:

an image-forming-apparatus body;

an attachable-detachable unit that is attachable to and detachable from the image-forming-apparatus body;

an electronic component that is provided in the attachable-detachable unit and that has a connection electrode exposed on a surface of a substrate;

a support member that is provided in the attachable-detachable unit and that supports the substrate of the electronic component in abutment with an attachment surface so as to allow the connection electrode to be externally connectable, the support member having a positioning supporter that elastically deforms by being relatively joined to a positioning portion provided in the substrate and that positions and supports the substrate to the attachment surface with restoring force generated as a result of the elastic deformation, the positioning portion comprising a circular through-hole and the positioning supporter including an arm portion that elastically deforms and another positioning portion extending upward from a tip end of the arm portion and inserted into the circular through-hole, the another positioning portion not facing the attachment surface and an area over the another positioning portion being open upward from the substrate of the electronic component and configured to allow passage therethrough when the substrate of the electronic component is being attached to the attachment surface; and a connection terminal that is provided in the image-forming-apparatus body and that is electrically connected to the connection electrode of the electronic component when the attachable-detachable unit is attached to the image-forming-apparatus body.

10. An electronic-component attachment structure comprising:

an electronic component having a connection electrode exposed on a surface of a substrate; and a support member that supports the substrate of the electronic component in abutment with an attachment so as to allow the connection electrode to be externally connectable, the support member having a positioning supporter that elastically deforms by being relatively joined to a positioning portion provided in the substrate and that positions and supports the substrate to the attachment surface with restoring force generated as a result of the elastic deformation, the positioning supporter including another positioning portion, the another positioning portion not facing the attachment surface and an area over the another positioning portion being open upward from the substrate of the electronic component and configured to allow passage therethrough when the substrate of the electronic component is being attached to the attachment surface wherein a tip end surface of the another positioning portion having a diameter smaller than a diameter of the positioning portion and a bottom surface of the another positioning portion having a diameter larger than a diameter of the positioning portion.

11. An electronic-component attachment structure comprising:

an electronic component having a connection electrode exposed on a surface of a substrate; and a support member that supports the substrate of the electronic component in abutment with an attachment surface so as to allow the connection electrode to be externally connectable, the support member having a positioning supporter that elastically deforms by being relatively joined to a positioning portion provided in the substrate and that positions and supports the substrate to the attachment surface with restoring force generated as a result of the elastic deformation, the positioning supporter including another positioning portion having a substantially circular truncated cone shape with a narrowed end, the another positioning portion not facing the attachment surface and an area over the another positioning portion being open upward from the substrate of the electronic component and configured to allow passage therethrough when the substrate of the electronic component is being attached to the attachment surface.

* * * * *